US005729799A

United States Patent [19]

Numao et al.

[11] Patent Number: 5,729,799

[45] Date of Patent: Mar. 17, 1998

[54] IMAGE FORMING METHOD AND APPARATUS HAVING A SEMICONDUCTIVE INTERMEDIATE TRANSFER MEMBER

[75] Inventors: Kazunori Numao; Noriaki Kojima; Masao Okubo; Nobukazu Takahashi, all of Ebina, Japan

[73] Assignee: Fuji Xerox Co., Ltd., Tokyo, Japan

[21] Appl. No.: 730,760

[22] Filed: Oct. 15, 1996

[30] Foreign Application Priority Data

Oct. 17, 1995 [JP] Japan ..... 7-293355
Oct. 11, 1996 [JP] Japan ..... 8-289383

[51] Int. Cl.[6] ..... G03G 21/00; G03G 15/16

[52] U.S. Cl. ..... 399/128; 399/308

[58] Field of Search ..... 399/302, 308, 399/129, 128, 99

[56] References Cited

U.S. PATENT DOCUMENTS 4,351,603 9/1982 Tagawa ..... 399/129 X
4,474,455 10/1984 Hirakura et al. ..... 399/128
5,404,205 4/1995 Saito ..... 399/129

FOREIGN PATENT DOCUMENTS 62-206567 9/1987 Japan .
5-224575 9/1993 Japan .
5-313540 11/1993 Japan .

*Primary Examiner*—S. Lee
*Attorney, Agent, or Firm*—Oliff & Berridge, P.L.C.

[57] ABSTRACT

An image forming apparatus of such a type as is provided with a photosensitive member having a semi-conductive intermediate transfer member disposed opposite the photosensitive member. A charger electrically charges the photosensitive member. An exposure device forms an electrostatic latent image on the photosensitive member and developer visualizes the electrostatic latent image using toner identical in polarity to the photosensitive member. A primary transfer device transfers the toner image to the intermediate transfer member by applying a bias opposite in polarity to the photosensitive member, and a secondary transfer apparatus transfers the toner image on the intermediate transfer member to a transfer material. An optical charge-eliminator optically removes the electrical charge from the photosensitive member. A contact charge-eliminator is provided between the optical charge-eliminator and the primary transfer device so as to completely eliminate the electric charge injected into the photosensitive member at the time of the primary transfer.

10 Claims, 21 Drawing Sheets

| | |
|---|---|
| NON-CONDUCTIVITY | ●——● |
| SEMICONDUCTIVITY | ○——○ |

1dyn: VALUE OF CURRENT FLOWING ON PHOTOSENSITIVE DRUM

| | |
|---|---|
| 1dyn = 20 μA | □---□ |
| 1dyn = 25 μA | ○——○ |
| 1dyn = 30 μA | ×----× |
| 1dyn = 35 μA | △—·—△ |

IMAGE FORMING METHOD AND APPARATUS HAVING A SEMICONDUCTIVE INTERMEDIATE TRANSFER MEMBER

BACKGROUND OF THE INVENTION

1. Field of the Invention

The present invention relates to an image forming method and apparatus such as a copying machine, a printer and the like using electrophotography and more particularly to improvements in an image forming method and apparatus of a type using a semiconductive intermediate transfer member.

2. Description of the Related Art

Japanese Patent Laid-Open Publication No. 206567/1987, for example, discloses what has heretofore been known as one of the typical conventional image forming apparatus.

The image forming apparatus comprises, as shown in FIG. 18, for example, the following around a photosensitive drum 101: a uniform charger 102; a laser exposure devices 103; developing devices 104 each corresponding to black (BK), yellow (Y), magenta (M) and cyan (C); a semiconductive intermediate transfer belt 105; a corona discharger 106 for primary transfer use; a drum cleaner 107 for removing residual toner on the photosensitive drum 101; and erase lamp 108 for removing the o residual electric charge on the photosensitive drum 101.

The image forming process in such an image forming apparatus includes forming a toner image T of each color on the photosensitive drum 101 uniformly charged by the uniform charger 102 every turn by means of the laser exposure device 103, stacking these toner images on the intermediate transfer belt 105 rotating in synchronization with the photosensitive drum 101 and making a secondly transfer of the multiple toner image T formed with the toner images T thus stacked up from the intermediate transfer belt 105 to transfer paper 109 to form a desired image on the transfer paper 109.

At a primary transfer step in connection with the image forming process, on the other hand, a voltage opposite in polarity to the voltage applied to the toner is applied by the corona discharger 106 from the back surface side of the semiconductive intermediate transfer belt 105 in the primary transfer region and the toner image T on the photosensitive drum 101 is electrostatically attracted to the intermediate transfer belt 105.

In the prior art example above, however, the semiconductive intermediate transfer belt 105 instead of an insulating one has been employed for the following reason:

Supposing that an insulating intermediate transfer belt 105 is used, the electric applied by the corona discharger 106 from the inside of the intermediate transfer belt 105 during the primary transfer operation is to be stored on the back surface side without escaping therefrom. Therefore, it is needed to provide on the inside of the intermediate transfer belt 105 a charge eliminator capable of applying the voltage opposite in polarity to that of the corona discharger.

Supposing that such a charge eliminator is provided so as to eliminate the electric charge on each image forming cycle, further, a repulsive electric field is generated because the polarity of the voltage applied by the charge eliminator is equal to that of the toner image for the primary transfer onto the intermediate transfer belt 105. Consequently, the primary transfer of the toner image onto the intermediate transfer belt 105 may cause image destruction.

Supposing that the charge elimination is conducted at timing at which no toner image for the primary transfer exists on the intermediate transfer belt 105, for example, for every copying job corresponding to the set number of sheets, on the other hand, the voltage applied by the corona discharger several times is stored on the back surface side of the intermediate transfer belt 105 and charged up, which results in the necessity of installing a large-sized, expensive charge eliminator. After all, it is difficult to put an insulating intermediate transfer belt 105 for practical use.

The use of the semiconductive intermediate transfer belt 105 on the contrary prevents the voltage applied by the corona discharger from being stored on the back surface of the intermediate transfer belt 105 without escaping therefrom and makes it unnecessary to provide a charge eliminator apart from the corona discharger.

Although the reason stated above has promoted the utilization of the semiconductive intermediate transfer belt 105, new technical problems were found to arise from the semiconductivity of the intermediate transfer belt 105 in that an image is caused to develop a qualitative defect by the injection of electric charge into the photosensitive drum 101.

The qualitative defect of such an image is considered attributable to the fact that when the intermediate transfer belt 105 is semiconductive, the electric charge discharged from the corona discharger passes through the intermediate transfer belt 105.

In other words, a difference in the quantity of electric charge injected in the surface of the photosensitive drum 101 is brought about even when the same bias voltage is applied as shown in FIG. 9, which difference is dependent on whether the intermediate transfer belt 105 is non-conductive or semiconductive and whether the surface of the photosensitive drum 101 is a non-image portion or an image portion.

As shown in FIG. 19, it is presumed that the electric charge discharged from the corona discharger is allowed to pass through the semiconductive intermediate transfer belt 105 much more than the non-conductive one and that the electric charge discharged from the corona discharger is allowed to pass through the non image portion much more than the image portion.

FIG. 20 shows the results of studying potential fluctuations at the photosensitive drum 101 before and after the primary transfer; more specifically, it shows the tendency of potential at the photosensitive drum 101 after the primary transfer when the potential at the photosensitive drum 101 is varied from about −600 V to about −200 V before the primary transfer.

As shown in FIG. 20, the use of the semiconductive intermediate transfer belt 105 (segment line A) in comparison with the use of the non-conductive intermediate transfer belt 105 (segment line B) shows that a considerable quantity of electric charge has been injected into the surface of the photosensitive drum 101.

Further, FIG. 21 shows the results of studying time variability of potential in the image and non-image portions of the photosensitive drum 101; more specifically, it shows the tendency of potential at the photosensitive drum 101 at the respective points of time after charging, exposure, transfer, recharging and re-exposure.

As shown in FIG. 21, the quantity of electric charge injected into the non-image portion on the surface of the photosensitive drum 101 (arrow B) becomes considerably greater than what has been injected into the image portion. Moreover, the potential at the non-image portion is shown not to rise up to a charge target value at the time of recharging after one round of the photosensitive drum 101.

Further, FIG. 22 shows the results of studying the effect of varying a primary transfer current value Idyn from 20 μA up to 35 μA stepwise in the case of FIG. 20.

As shown in FIG. 22, the potential at the photosensitive drum 101 after the primary transfer is seen to vary toward the positive electrode side further in a case where the properties of photosensitive material are negative as the primary transfer current value rises within a range of Idyn= 20 μA–35 μA stepwise.

In the conventional color image forming apparatus, the process described above is therefore usually practiced to obtain a multiplex toner image by successively transferring toner images on the photosensitive drum 101 onto the intermediate transfer belt 105 in a multiplex way. When the value of the transfer current applied with the primary transfer is successively raised on a color cycle basis, electric charge opposite in polarity to the properties of the photosensitive material tends to stay on the photosensitive drum 101, so that an image inferior in quality may easily appear in company with the residual charge opposite in polarity.

A detailed description will subsequently be given of a specific mechanism by which an image inferior in quality is produced with reference to FIG. 23.

FIG. 23 refers to an exemplary case where an image of A3 in size is formed while the photosensitive drum 101, for example, turns twice, wherein the image of A3 is formed through the steps of: (a) forming a toner image (charging, exposure and development); (b) making the primary transfer; (c) eliminating the electric charge; (d) performing the charging operation; and (e) effecting exposure. Each processing step will be described below.

(a) Image forming step (charging, exposure and development)

When a region corresponding to the image portion on the photosensitive drum 101 uniformly charged with a potential of VH by the uniform charger 102 is exposed by the laser exposure device 103, an electrostatic latent image at a potential of VL in the place where the potential is lowest.

The electrostatic latent image is immediately visualized by the developing devices 104 and an toner image T is formed thereby.

(b) Primary transfer step

When a voltage opposite in polarity to the voltage on the surface of the photosensitive drum 101 is applied by the corona discharger 106 from the back surface of the semiconductive intermediate transfer belt 105 to the primary transfer region during the one turn of the photosensitive drum 101 to make the primary transfer of the toner image T, the voltage thus applied is passed through the intermediate transfer belt 105 and injected into a photosensitive layer on the surface of the photosensitive drum 101.

Since the toner is absent in the region corresponding to the non-image portion, the electric charge is then directly injected into the surface of the photosensitive drum 101, whereas since the toner is present in the region (electrostatic latent image portion) corresponding to the image portion, the quantity of electric charge injected into the surface of the photosensitive drum 101 is smaller than that of what is injected into the non-image portion.

Therefore, the potential at the region corresponding to the image portion on the surface of the photosensitive drum 101 slightly varies from potential VL to VL', whereas the potential at the region corresponding to the non-image portion thereon greatly varies from the potential VH to VH'.

(c) Charge eliminating step

As the photosensitive drum 101 turns, it is subjected by the erase lamp 108 to optical charge elimination.

Although the potential at the region corresponding to the aforementioned image portion having the minus electric charge is eliminated up to substantially 0 V, the potential at the region corresponding to the image portion having the positive charge is left as it is.

(d) Charging step

When the photosensitive drum 101 enters into the second turn, it is uniformly charged by the uniform charger 102 again so that the surface of the photosensitive drum 101 may be uniformly charged with the prescribed VH. However, the target value VH remains unobtainable even though it is attempted to charge the photosensitive drum 101 with the target potential VH because the positive potential has been left in the non-image portion during the first turn of the photosensitive drum 101, which results in causing irregularity to the charged potential.

(e) Exposure step

With the irregularity of the charged potential thus maintained, the exposure of the photosensitive drum by means of the laser exposure device 103 allows the potential to be formed in a state in which the non-conformity of the charged potential is directly contained in potential after the exposure. Therefore, a difference in density (a so-called development ghost) is caused between the non-image portion and the image portion and an image inferior in quality is produced.

In order to prevent the aforementioned image inferior in quality, it is reasoned to arrange a charge-eliminating corona discharger 110 opposite to the photosensitive drum 101 as shown in FIG. 18, for example, so that the electric charge injected into a photosensitive layer on the surface of the photosensitive drum 101 as a source of producing an image inferior in quality is removed by applying to the discharge wire of the charge-eliminating corona discharger 110 a bias voltage identical in polarity to the charged voltage of the photosensitive drum 101.

When the method of removing the electric charge from the surface of the photosensitive drum 101 using the charge-eliminating corona discharger 110 was used to form an overall halftone image by running one and the same image (e.g., what has a solid portion and a peripheral background portion (white portion)) on trial, a difference in density between an image portion and a non-image portion (background portion) was detected (density reduction was found in the non-image portion) and there arose a new technical problem in that part of the output image was left blank in an extreme case.

The reason for the development of such a problem is considered attributable to the generation of ozone in great quantities due to the irradiation of the photosensitive drum 101 with corona discharge and the adhesion of the substances (e.g., NOx) generated by electric discharge because of the ozone to the surface of the intermediate transfer belt 105 corresponding to the non-image portion, whereby deterioration in the transferability of a toner image occurs because the adhesion of toner to the surface of the intermediate transfer belt 105 increases on the deposit, thus leading to bad secondary transfer.

SUMMARY OF THE INVENTION

The present invention was made to solve the foregoing technical problems, and therefore an object of the invention is to provide an image forming method and apparatus capable of forming a good image free from a difference in density, a blank portion and inferior quality by ensuring that electric charge injected into a photosensitive layer through a semiconductive intermediate transfer member in order to not only eliminate the irregularity of the charged potential but also avoid the bad secondary transfer accompanied by the adhesion of the substances produced by electric discharge to the semiconductive intermediate transfer member.

An image forming method according to the present invention comprises the steps of uniformly electrically charging a photoconductive layer on the surface of a photosensitive member with charging means, exposing the surface of the photosensitive member to form an electrostatic latent image corresponding image information with exposure means, forming a toner image to visualize the electrostatic latent image with developing means which is stored with toner identical in polarity to the photosensitive member, making a primary transfer of the toner image to a semiconductive intermediate transfer member by electrically charging the semiconductive intermediate transfer member at a potential opposite in polarity to the potential at the photosensitive member with primary transfer means, making a secondary transfer of the toner image on the intermediate transfer member to a transfer material with secondary transfer means, contact-eliminating electric charge for eliminating the residual potential on the photosensitive member after the primary transfer by causing a conductive member to which a bias is applied by bias applying means to contact the photosensitive member and then optically removing the electric charge from the photosensitive member with optical charge-eliminating means 9 after the contact charge eliminating step.

An image forming apparatus for implementing such an image forming method comprises: a photosensitive member whose surface is covered with a photoconductive layer, a semiconductive intermediate transfer member disposed opposite to the photosensitive member, charging means for uniformly electrically charging the surface of the photosensitive member, exposure means for forming an electrostatic latent image corresponding to image information on the photosensitive member, developing means for forming a toner image by visualizing the electrostatic latent image using toner identical in polarity to the photosensitive member, primary transfer means for transferring the toner image to the intermediate transfer member by electrically charging the intermediate transfer member at a potential opposite in polarity to the potential at the photosensitive member, secondary transfer means for transferring the toner image on the intermediate transfer member to a transfer material, optical charge-eliminating means placed on the downstream side in the direction in which the photosensitive member is rotated in a region corresponding to the primary transfer means, which region is located close to the photosensitive member, contact charge-eliminating means placed close to the photosensitive member and between the region corresponding to the primary transfer means and the optical charge-eliminating means, wherein the contact charge-eliminating means includes a conductive member which makes contact with the surface of the photosensitive member and bias applying means for applying to the conductive member a bias for removing the residual potential on the photosensitive member after the primary transfer.

In such a technical means as stated above, it doesn't matter whether the charged properties of the photosensitive member are negative or positive and, moreover, whether the photosensitive member itself is in the form of a drum or a belt, for example, and besides any type of exposure method may be adopted.

With respect to the semiconductive intermediate transfer member, it also doesn't matter whether it is drum- or belt-shaped, for example, as far as its semiconductivity (about $10^2$–$10^{14}$ Ω.cm) is capable of temporarily holding a toner image. In a case where an endless belt made of elastic material is employed, moreover, use can be made of resin of such as acryl, vinyl chloride, polyimide, polycarbonate, polyurethane, polyester, nylon and PVdF or various kinds of rubber containing a suitable quantity of an antistatic agent such as carbon black.

As the developing means, further, it doesn't matter whether it is a monochromatic or a multicolor image forming apparatus as far as the electrostatic latent image formed on the photosensitive member can be visualized with toner by the charging means and the exposure means.

As the primary transfer means, further, it is only required to be able to transfer the toner image T on the photosensitive member onto the semiconductive intermediate transfer member by applying the bias voltage from the back surface of the semiconductive intermediate transfer member toward the photosensitive member; normally a corona discharger or the like is used.

The conductive member in the contact charge-eliminating means is only needed to function as an electrode means for applying the bias voltage to the photosensitive member. However, in view of preventing the surface of the photosensitive member from suffering from any flaw as much as possible, a conductive film made of polyimide or polycarbonate is preferably used as the conductive member and it is also preferred that the contact width with the photosensitive member is set to 3 mm or less or otherwise the belly portion, excluding its leading end portion, of the conductive member is made to contact the photosensitive member.

From the structural point of view wherein the conductive member is allowed to demonstrate stable performance as an electrode member, the surface resistivity of the conductive member should preferably range from $10^2$ to $10^{11}$.Ω/□.

In a case where the cleaning means for peeling and removing the residual toner on the photosensitive member, it is preferred to use a toner receiving member attached to a conventional cleaning means simultaneously as the conductive member without using such a conductive member separately in view of making an image forming apparatus small-sized and less costly.

With this arrangement, it is possible to not only reducing the number of parts but also eliminate electric charge from waste toner to be recovered by the cleaning means.

The bias applying means in the contact charge-eliminating means may be adapted so as to apply only the d.c. bias or a combination of d.c. and a.c. biases by superposing one on top of the other.

In view of preventing a flaw from being produced in an image in a type where a negatively-polarized photosensitive member is used, for example, the d.c. voltage ranges from −0.8 kV to −2.0 kV when only the d.c. bias is applied thereto and in a type where the d.c. bias is superposed on the a.c. bias, the a.c. voltage whose peak-to-peak voltage ranges from 1.0 kV to 4.1 kV is preferably combined with the d.c. voltage ranging from −0.6 kV to −2.0 kV. Incidentally, use of an identically polarized or alternating-voltage-superposed d.c. voltage within a predetermined range may be used in a type where a positively polarized photosensitive member.

In view of not promoting the fatigue of the photosensitive member with time, further, the timing at which the bias voltage is applied to the conductive member is effected only when the photosensitive member is electrically charged by the primary transfer means, for example, using the bias applying means.

Although the bias voltage applied to the conductive member may be constant, further, removal of the electric charge at the photosensitive member tends to become insufficient in proportion to the degree of its fatigue and particularly when a high bias voltage is set from the beginning, the fatigue of the photosensitive member grows greater, which is undesired.

Therefore, the fatigue of the photosensitive member should be minimized to ensure the electric charge is eliminated from the photosensitive member satisfactorily. In view of this, the bias voltage applied to the conductive member should preferably be raised as the fatigue of the photosensitive member with time increases.

Moreover, use of a charge eliminating means of a type in contact with the photosensitive member itself instead of the charge eliminating means of the type in non-contact with the photosensitive member such as a corona discharger may be well known.

However, the "contact charge-eliminating means" according to the present invention is entirely irrelevant to the know contact charge-eliminating technique and a description will be supplemented of this relationship.

Japanese Patent Laid-Open Nos. 224575/1993 and 313540/1993 disclose the contact charge-elimination techniques.

Japanese Patent Laid-Open No. 224575/1993 is intended to prevent an image inferior in quality from being produced by rendering at least either cleaning blade or film seal conductive and placing it in contact with the surface of a photosensitive member, whereby static electricity is restrained from being injected into the photosensitive member due to the friction between the cleaning blade of the photosensitive member and the film seal, which friction arises from vibration and shock during transportation and transfer.

Further, Japanese Patent Laid-Open No. 313540/1993 makes it an object to place a conductive film in contact with a photosensitive member and to remove the electric charge of carrier remaining on the photosensitive member by applying voltage to a cleaning device of the photosensitive member at the prior timing at which the voltage reaches the cleaning device in order to lower the electrical adhesion of the carrier to the surface of the photosensitive member and to facilitate the peeling operation when cleaning is carried out.

In both cases above where the conductive member is placed in contact with the photosensitive member to eliminate the static electricity on the photosensitive member, an object to be eliminated is the static electricity produced by vibration and shock according to Japanese Patent Laid-Open No. 224575/1993, whereas it is the electric charge of the carrier on the photosensitive member according to Japanese Patent Laid-Open No. 313540/1993.

The known prior art contact charge-eliminating techniques lack the perception of the problems set forth as a premise according to the present invention that the electric charge injected into a photosensitive member through a semiconductive intermediate transfer member at the time of primary transfer is reset and bad secondary transfer arising from the adhesion of the substances produced by electric discharge to the semiconductive intermediate transfer member is obviated. For this reason, the conventional contact charge-eliminating techniques are irrelevant to the "contact charge-eliminating means" according to the present invention.

The function of the apparatus according to the present invention will be described with reference to the aforementioned technical means. The photosensitive member in this case has negatively charged properties for convenience of explanation.

First, when the surface of the photosensitive member is negatively charged by the charging means as the photosensitive member rotates, the exposure means forms an electrostatic latent image on the photosensitive member. Then the electrostatic latent image is visualized by the developing means, so that the toner image is formed on the photosensitive member.

Subsequently, the toner image is conveyed to the vicinity of the primary transfer region as the photosensitive member rotates and the positively polarized voltage is applied thereto by the primary transfer means from the back surface side of the semiconductive intermediate transfer member, whereby the toner image is transferred onto the semiconductive intermediate transfer member.

Since the intermediate transfer member is semiconductive, the voltage thus transferred by the primary transfer means is passed through the intermediate transfer member and injected into the photosensitive member. At this time, the positively polarized voltage is injected into the photosensitive member that has remained negatively polarized, whereas the positively polarized charge is left in the non-image portion which is not loaded with a relatively large quantity of the toner injected.

Subsequently, the region into which the voltage transferred from the photosensitive member is injected and then transferred to the vicinity of the conductive member of the contact charge-eliminating means as the photosensitive member rotates. Further, the negatively polarized bias voltage is applied by the bias applying means via the conductive member to the photosensitive member.

Then, the potential at the photosensitive member where the positively polarized charge remains in part of the area is returned to the negatively polarized one again.

Further, the potential at the photosensitive member totally and negatively polarized then is optically removed by the optical charge-eliminating means and the whole area thereon is reset.

Moreover, the secondary transfer of the toner image on the semiconductive intermediate transfer member to the transfer material is made by the secondary transfer means.

As the corona discharge method has not been employed at this time, the contact charge-eliminating means is not made to produce a large quantity of ozone and therefore the substances (e.g., NOx) produced by electric charge is restrain from adhering to the semiconductive intermediate transfer member corresponding to the non-image portion.

Consequently, even if an overall halftone image is formed after the running of the same image, the adhesion of the tone of the overall halftone image on the semiconductive intermediate transfer member is restrained from locally increasing in accordance with a portion corresponding to the non-image portion of the same image, whereby the overall halftone image is transferred to the transfer material at a uniform density without blank portions.

BRIEF DESCRIPTION OF THE DRAWINGS

The above and other objects and features of the present invention will be more apparent from the following description taken in conjunction with the accompanying drawings.

DETAILED DESCRIPTION OF THE PREFERRED EMBODIMENTS

A description will subsequently be given in more detail of embodiments of the present invention with reference to the accompanying drawings.

(Embodiment 1)

Figure 1:
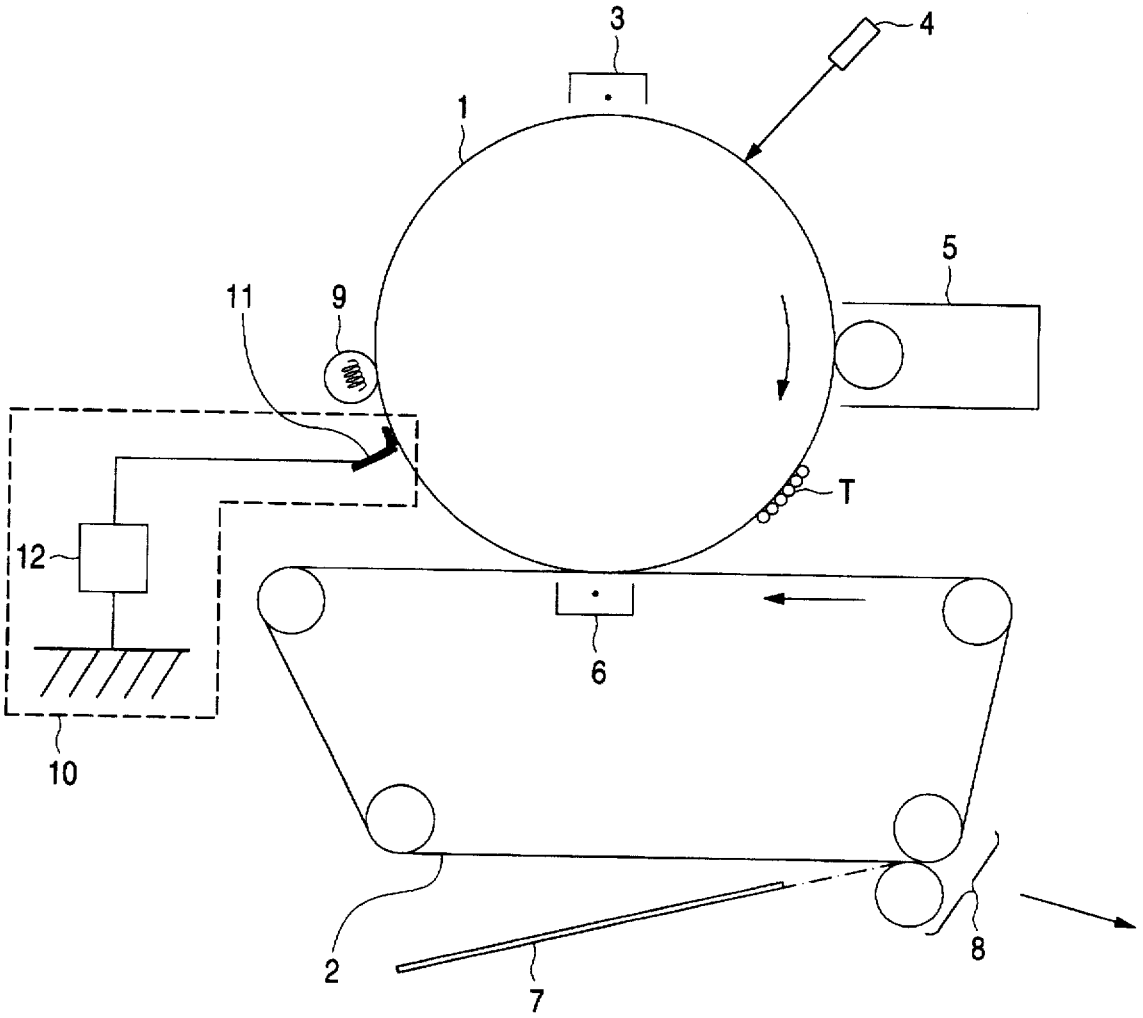
FIG. 1 is a schematic diagram showing an image forming method and apparatus according to the present invention.
Figure 2:
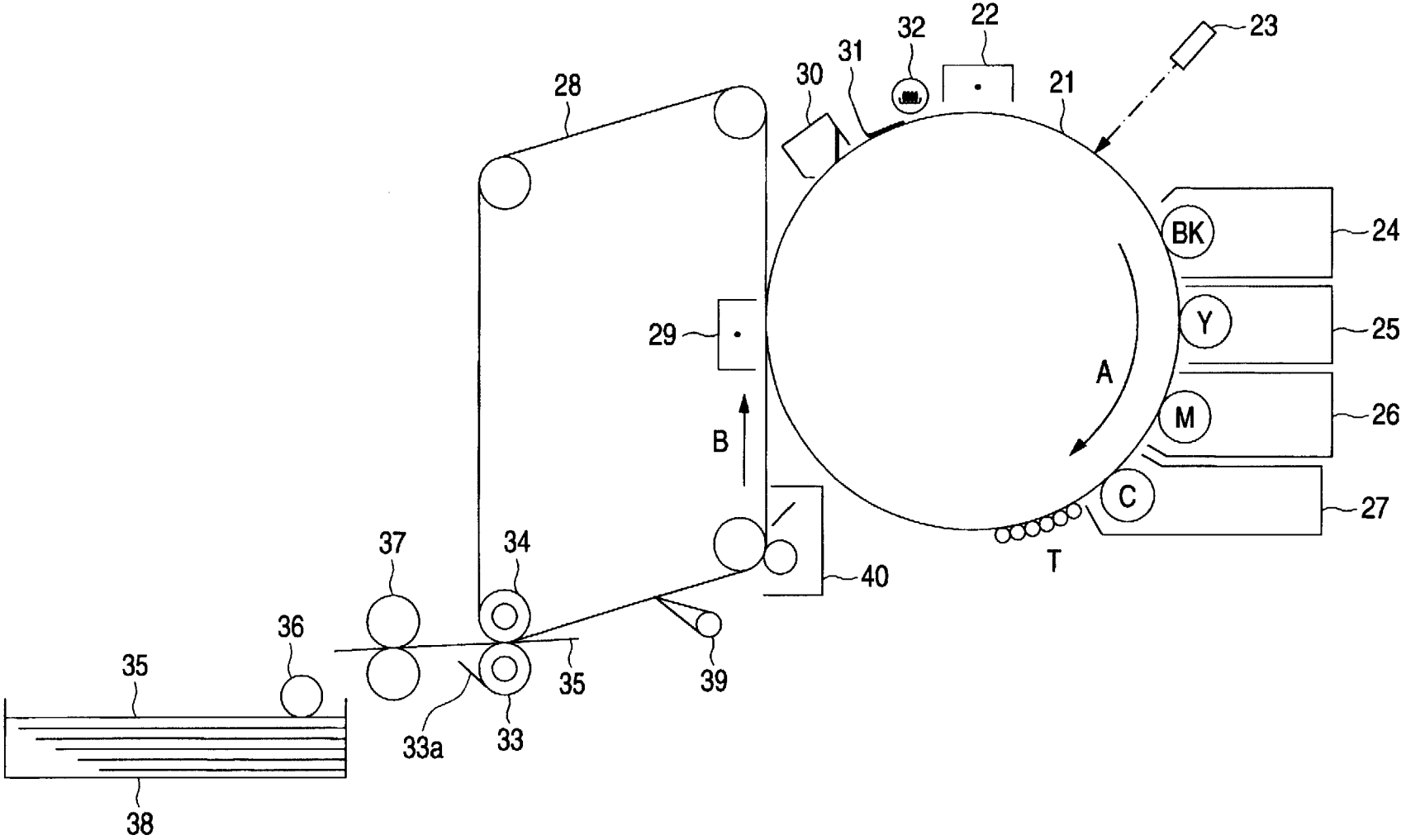
FIG. 2 is a schematic diagram showing a color image forming apparatus according to an embodiment 1 of the present invention.

FIG. 2 shows an embodiment 1 of the present invention applied to a color image forming apparatus.

In FIG. 2, reference numeral 21 denotes a negatively polarized photosensitive drum (OPC-IR); 22, a uniform charger for pre-charging the photosensitive drum 21; 23, a laser exposure device for writing an electrostatic latent image on the photosensitive drum 21 thus charged; and 24 to 27, developing devices (24, a developing device for black; 25, a developing device for yellow; 26, a developing device for magenta; and 27, a developing device for cyan) which are attachable to and detachable from the photosensitive drum 21 each in developing positions facing the photosensitive drum 21.

Further, reference numeral 28 denotes an intermediate transfer belt which is placed so as to make contact with the surface of the photosensitive drum 21, stretched on a plurality of rolls (not shown with reference numerals) and rotated in the direction of an arrow B. According to this embodiment of the invention, a suitable quantity of carbon black, that is, an antistatic agent is contained in a polycarbonate having a thickness of 0.1 mm and a volume resistivity of $10^{10}$ Ω.cm.

Further, reference numeral 29 denotes a corona discharger for making the primary transfer of each toner image T on the photosensitive drum 21 onto the intermediate transfer belt 28; 30, a drum cleaner for removing the residual toner on the photosensitive drum 21; 31, a contact charge eliminator 31 for applying a voltage identical in polarity to the charged voltage of the photosensitive drum 21 to the photosensitive drum 21 to remove the residual potential thereon; and 32, an erase lamp for ultimately reducing the potential on the photosensitive drum 21 to substantially zero by light irradiation.

Further, reference numeral 33 denotes a transfer roll to which a bias for secondary transfer; 33*a*, a cleaning blade made of polyurethane rubber and used for peeling off toner sticking to the surface of the transfer roll 33; 34, a conductive roll placed on the back surface side of the intermediate transfer belt 28, forming an opposed electrode of the transfer roll 33; 36, a feed roll for conveying the transfer paper 35 to a secondary transfer region at predetermined timing; 37, guide rolls for conveying and guiding the transfer paper 35 conveyed from the feed roll 36 to the secondary transfer region; 38, a transfer paper supplying tray for supplying transfer paper 35 of predetermined size; 39, a peeling pawl for forcibly peeling the transfer paper 35 electrostatically sticking to the intermediate transfer belt 28; and 40, a belt cleaner for peeling and removing the residual toner on the intermediate transfer belt 28.

As shown in FIG. 2, the contact charge eliminator 31 is placed around the photosensitive drum 21 and on the upstream side in the direction in which the photosensitive drum 21 rotates with respect to the erase lamp 32 arranged between the primary transfer region where the intermediate transfer belt 28 faces the photosensitive drum 21 and the uniform charger 22.

Figure 3:
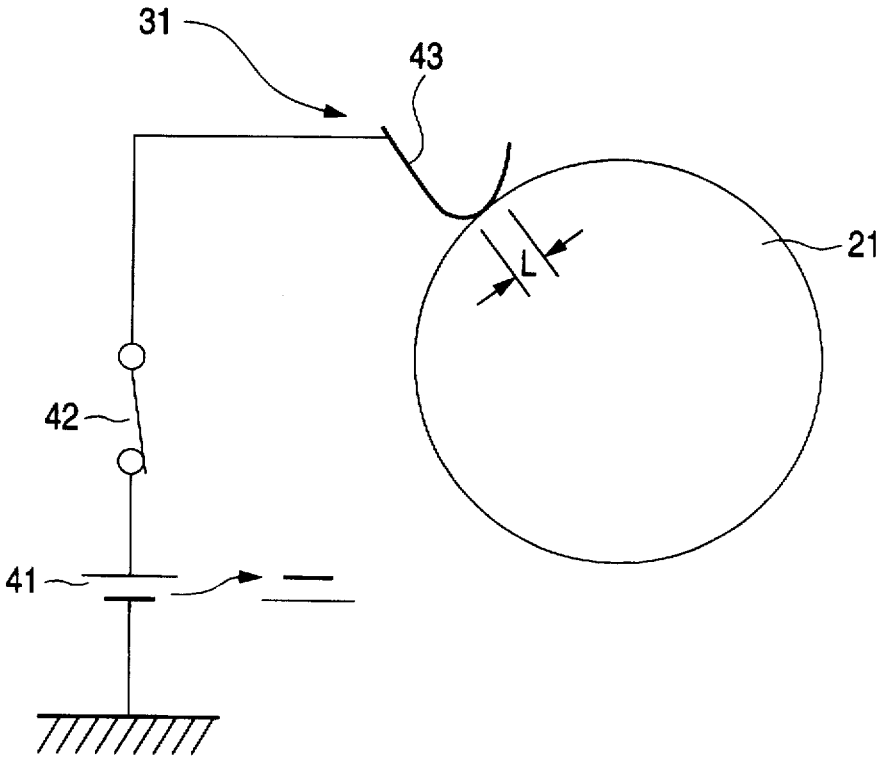
FIG. 3 is an illustration showing the operation of a conductive film in the embodiment 1 of the present invention.

As shown in FIG. 3, further, the contact charge eliminator 31 connects a d.c. power supply 41 via a switch 42 to a conductive film 43 so that the bias voltage is selectively applied to the conductive film by opening and closing the switch 43 on and off.

With reference to FIG. 3, the conductive film 43 is L-shaped in cross section and its belly excluding the leading end portion out of what extends laterally is kept in contact with the photosensitive drum 21.

With respect to the conductive film 43, what is used according to this embodiment of the invention is prepared by, for example, having a suitable quantity of an antistatic agent such as carbon black contained in a polycarbonate having a thickness of 50–300 μm and a surface resistivity of $10^6\Omega/\square$.

In this case, the reasons for the use of polycarbonate in the conductive film 43 are that as shown in Table 1 (indicating that streaks are not produced . . . O; some of the streaks are produced . . . Δ; and streaks are produced . . . x on images due to flaws in the photosensitive material), the polycarbonate offered the most favorable results when defects (streaks) of images based on several kinds of materials used for conductive films were examined one by one as far as flaws made in the surface of the photosensitive drum 21 are concerned and that as shown in Table 2, moreover, the mechanical properties of the conductive film 43 needs to be satisfactory enough to prevent time elastic deterioration with respect to the photosensitive drum 21; more specifically, they include a Young's modulus of 200 ($kg/mm^2$) or greater and a tensile strength of 550 ($kg/cm^2$) or greater.

TABLE 1

| Material | Streaks on images due to flaws in photosensitive materials |
|---|---|
| Polyimide | o |
| Polycarbonate | o |
| PVdF | x |
| Urethane | Δ |
| Polyester | Δ |
| Nylon | x |

TABLE 2

| Material | Young's modulus | Tensile strength |
|---|---|---|
| Polyimide | 610 | 2050 |
| Polycarbonate | 210 | 580 |
| PVdF | 200 | 490 |
| Urethane | 20 | 370 |
| Polyester | 400 | 1500 |
| Nylon | 130 | 550 |

Figure 4:
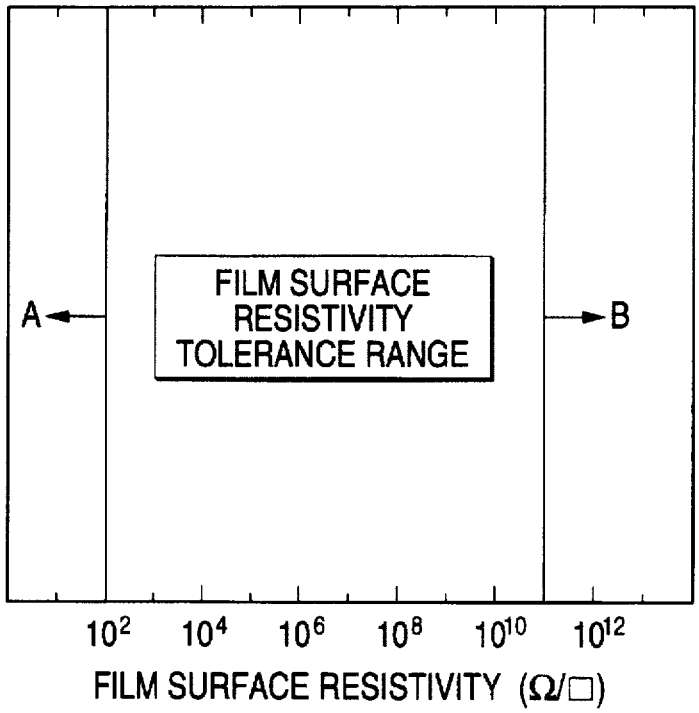
FIG. 4 is a graph showing a tolerance of the surface resistivity of the conductive film in the embodiment 1 of the present invention.

The reason for the use of $10^6\Omega/\square$ as the surface resistivity of the conductive film 43 is based on the experimental data shown in FIG. 4.

As shown in FIG. 4, a straight line A indicates the limit of the surface resistivity which leaks toward the photosensitive drum 21 because the resistance is low, whereas a straight line B also indicates the limit of the surface resistivity because a current sufficient to eliminate the electric charge injected into the photosensitive drum 21 does not flow as the resistance is high. In other words, FIG. 4 shows a tolerance of the surface resistivity of the conductive film 43 ranges from $10^2$ to $10^{11}\Omega/\square$. Therefore, it was decided to use the surface resistivity of the conductive film 43 within the aforementioned tolerance, for example, $10^2\Omega/\square$ according to this embodiment of the invention.

Figure 5:
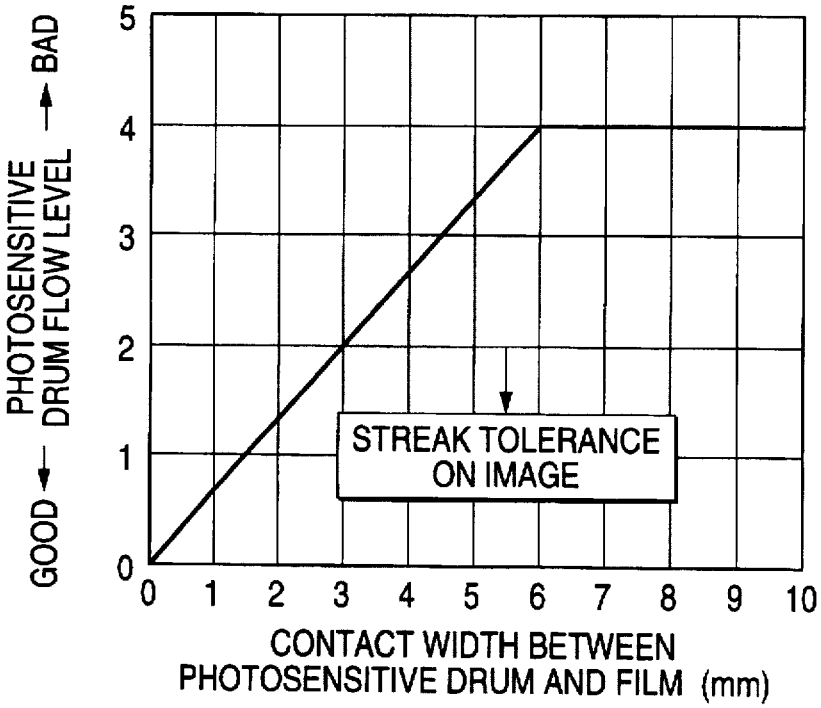
FIG. 5 is a graph showing the contact width between a photosensitive layer and the conductive film in the embodiment 1 of the present invention.

Although the contact width of the contact portion has been set to L=3 mm or less according to this embodiment of the invention, moreover, this is based on the experimental data indicating that the aforementioned contact width corresponding to the tolerance of the flaw level of the photosensitive drum 21 was 3 mm as shown in FIG. 5.

Figure 6:
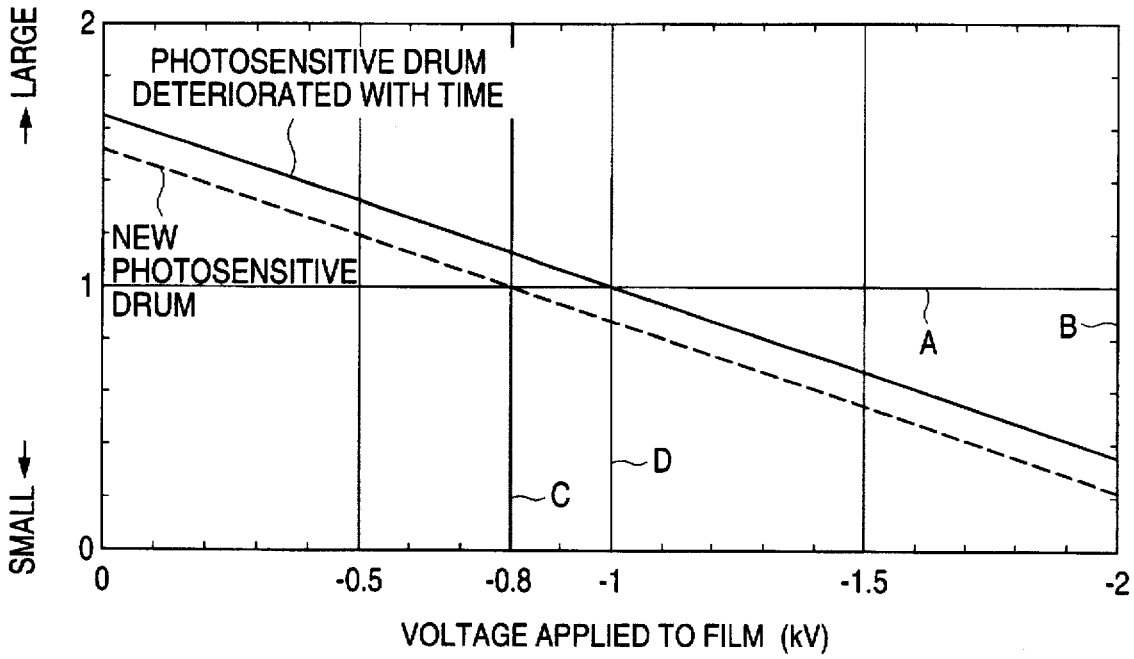
FIG. 6 is a graph showing the density difference between an original image portion and an original non-image portion with respect to the voltage applied to the conductive film in the embodiment 1 of the present invention.

Further, the bias voltage applied to the surface of the photosensitive drum 21 is needed to set from −0.8 to −2.0 kV according to this embodiment of the invention and the reason for this is furnished on the based of the experimental data shown in FIG. 6.

FIG. 6 refers to a difference in density between an original image portion and an original non-image portion with respect to variations in the voltage applied to the conductive film 43 in a case where the photosensitive drum 21 deteriorated with time is compared with a new one in terms of the density difference. More specifically, the primary transfer of the toner image T having both the image portion visualized on the photosensitive drum 21 and the non-image portion onto the intermediate transfer belt 28 is made and then the electric charge injected into the surface of the photosensitive drum 21 by the primary transfer is removed by the conductive film 43 at the first turn of the photosensitive drum first and then a new halftone toner image is developed before being caused to undergo the primary transfer in order to measure any difference in density between the original image and non-image portions at the second turn of the photosensitive drum 21.

In FIG. 6, a straight line A indicates the limit of a density difference that can be distinguished by visual observation; a straight line B the limit of potential applicable to the surface of the photosensitive drum 21; a straight line C the limit of a density difference that cannot be distinguished on the photosensitive drum 21; and a straight line D a density difference than cannot be distinguished on the photosensitive drum 21 deteriorated with time.

Therefore, the voltage applied to the conductive film 43 with the use of the d.c. bias is within the tolerance on condition that d.c. voltage identical in polarity to the charged voltage of the photosensitive drum 21 ranges from −0.8 kV to −2.0 kV in the case of such a new photosensitive drum 21.

Figure 7:
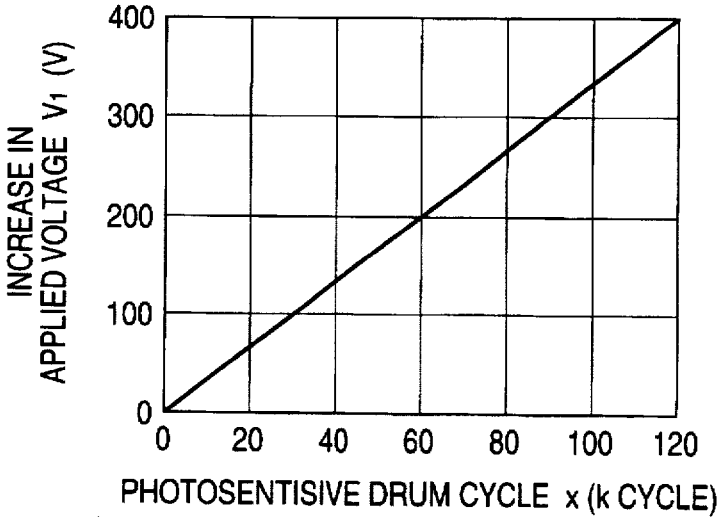
FIG. 7 is a graph showing an increase in the applied voltage with respect to the operating cycle of a photosensitive drum in the embodiment 1 of the present invention.

As shown in FIG. 7, further, fatigue with time is promoted as the working cycle of the photosensitive drum 21 is extended when a high voltage is applied to the photosensitive drum 21.

Consequently, the timing at which the voltage is applied to the conductive film 43 is set only when the primary transfer voltage is applied by the corona discharger according to this embodiment of the invention in view of increasing the life of the photosensitive drum 21.

A description will subsequently be given of an image forming process to be performed by the color image forming apparatus according to this embodiment of the invention with reference to FIGS. 2, 3 and 8. In this case, the description thereof will be started on the assumption that the potential on the surface of the photosensitive drum 21 is in the initial state (at substantial 0 over the whole area).

When an image of A3 in size is formed first, for example, the surface of the photosensitive drum 21 is uniformly negatively charged with the potential VH by the uniform charger 22 at the first turn while kept rotating in the direction of the arrow A. Subsequently, the image is subjected to exposure corresponding to a first color, for example, a black image and an electrostatic latent image at the potential VL corresponding to the black image is formed on the surface of the photosensitive drum 21.

Figure 8:
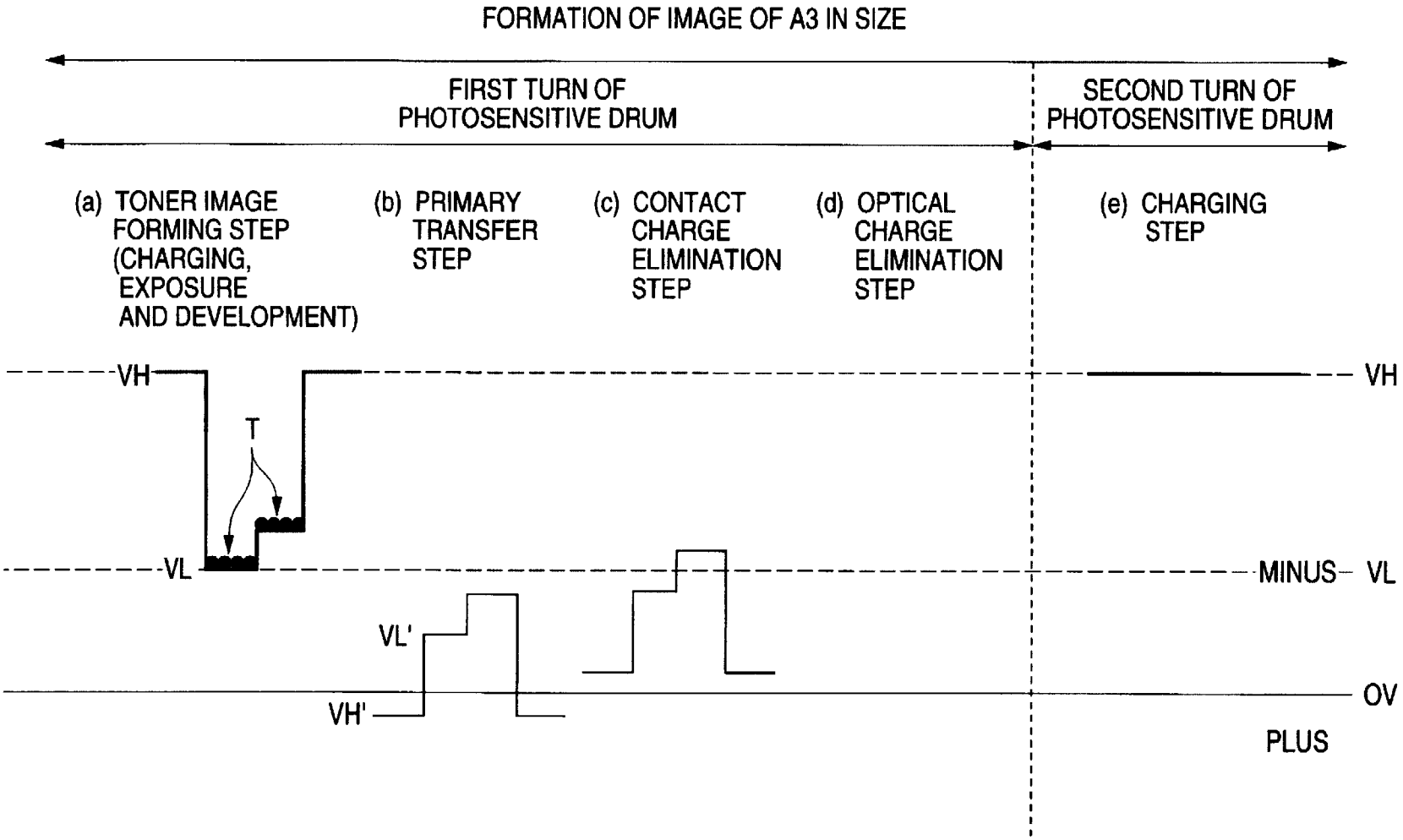
FIG. 8 is an illustration of a charge eliminating process in the embodiment 1 of the present invention.

Further, the developing device 24 for black is set close to the photosensitive drum 21 at such timing as is before the leading end of the electrostatic latent image corresponding to the black image arrives at the developing position and then a magnetic brush rubs against the electrostatic latent image to form a black toner image T on the photosensitive drum 21 (see the toner image forming process (a) of FIG. 8 regarding the steps of charging, exposure and development).

This black toner image is transferred from the photosensitive drum 21 onto the surface of the intermediate transfer belt 28 in the primary transfer region where the photosensitive drum 21 and the intermediate transfer belt 28 abut against each other.

In other words, when the corona discharger 29 discharges the positive charge opposite in polarity to the charged voltage of the toner from the back surface side of the intermediate transfer belt 28 toward the photosensitive drum 21 in the primary transfer region, the black toner image T on the photosensitive drum 21 is electrostatically attracted onto the intermediate transfer belt 28 and simultaneously the discharged charge is passed through the intermediate transfer belt 28 before being injected into the photosensitive layer on the surface of the photosensitive drum 21.

At this time, the positive charge is directly injected into the surface of the photosensitive drum 21 since the toner is absent in the region corresponding to the non-image portion, whereas the quantity of positive charge injected into the surface of the photosensitive drum 21 is considerably small since the toner is present in the region corresponding to the image portion in comparison with the non-image portion.

Therefore, the potential in the region corresponding to the image portion on the surface of the photosensitive drum 21 slightly varies from VL to VL', whereas the potential in the region corresponding to the non-image portion thereon sharply varies from VH to VH', whereby the electric charge having the positive polarity is left (see the primary transfer step (b) of FIG. 8).

As the photosensitive drum 21 rotates then, the latent image forming region (a toner image forming region) of the photosensitive drum 21 is conveyed close to the conductive film 43 and the switch 42 is closed, so that the negative bias voltage of the d.c. power supply 41 is applied via the conductive film 43 to the photosensitive layer on the surface of the photosensitive drum 21. Thereupon the potential at the photosensitive layer where the electric charge having the positive polarity stays thereon is caused to have the negative polarity again in all (see the contract charge elimination step (c) of FIG. 8).

Further, the potential at the photosensitive layer having the negative polarity on the whole is optically eliminated by the erase lamp 32 as the photosensitive drum 21 rotates and the whole area is reset thoroughly (see the optical charge elimination step (d) of FIG. 8).

With respect to the photosensitive drum 21 where the transfer of the black toner image has been completed, the black toner left on the surface is then scraped off by the drum cleaner 30.

Subsequently, the photosensitive drum 21 starts the second turn and the surface thereof with the whole area that has been reset without omission is uniformly charged with the potential VH as a target potential by the uniform charger 22 so as to follow the second color, for example, yellow image forming step.

Then image exposure corresponding to the yellow image is conducted by the laser exposure device 23 and the electrostatic latent image of the yellow image is formed on the surface of the photosensitive drum 21.

The developing device 24 for black is switched over to the developing device 25 for yellow and set close to the photosensitive drum 21 after the formation of the black toner image is terminated and the electrostatic latent image corresponding to the yellow image is developed by the magnetic brush. Further, the action of the corona discharger 29 causes the yellow toner image to be stacked on the black toner image this time by multiplex transfer in the primary transfer region where the photosensitive drum 21 and the intermediate transfer belt 28 abut against each other.

The residual toner on the surface of the photosensitive drum 21 is removed after the transfer of the yellow toner image is terminated like the black image forming step and then the whole area on the surface of the photosensitive drum 21 is reset without omission through the charge eliminating process of FIG. 8, that is, through the toner image forming step (a) to the charging step (e).

While holding the multiplex toner images of black and yellow, on the other hand, the intermediate transfer belt 28 has the next step ready.

Like the yellow image forming step, the third color, for example, magenta image forming step is then followed and finally the fourth color, for example, cyan image forming step is followed. Nevertheless, no irregularity of the charged potential is produced after resetting since the surface of the photosensitive drum 21 is reset without omission during the charge eliminating process each time the primary transfer of one color has been made.

Thus, the intermediate transfer belt 28 rotates so as to convey the four-color multiplex toner image to the secondary transfer region facing the conveying passage immediately after the final cyan image forming step as the primary transfer step is terminated.

In the aforementioned secondary transfer region, the transfer roll 33 is kept abutting against the intermediate transfer belt 28 and the transfer paper 35 is fed by the feed roll 36 out of the transfer-paper supplying tray 38 at predetermined timing and held between the transfer roll 33 and the intermediate transfer belt 28.

Then a bias opposite in polarity to the charged voltage of the tone is applied to the transfer roll 33 and the multiplex toner image T carried by the intermediate transfer belt 28 is electrostatically attracted to the transfer paper 35 in the secondary transfer region above, so that the secondary transfer is completed.

The transfer paper 35 with the multiplex toner image T thus transferred is peeled off the intermediate transfer belt 28 with the peeling pawl 39 and sent into a fixing device (not shown) where the multiplex toner image T is subjected to a fixing process.

After the termination of the secondary transfer region, on the other hand, the residual toner on the intermediate transfer belt 28 is scraped off and removed by the belt cleaner 40.

With the arrangement above, the transfer roll 33, the peeling pawl 39 and the belt cleaner 40 are set detachable from the intermediate transfer belt 28 and these members are detached from the intermediate transfer belt 28 until the primary transfer of the toner image with the final color of the color image to the intermediate transfer belt 28 is made.

Although the secondary transfer of the toner images T to the transfer paper 35 is made collectively after the toner images T are stacked on the intermediate transfer belt 28 once by repeatedly paying out the toner image T the same number of times as that of colors when the color image is formed as described above, the secondary transfer of a toner image of one color to the transfer paper 35 may be made immediately after the primary transfer of the toner image of that one color onto the intermediate transfer belt 28 is made when a chromatic image is formed.

In the aforementioned process of forming an image according to this embodiment of the invention, the charge eliminating process is performed after each primary transfer so as to reset the whole surface of the photosensitive drum 21 without omission and then the photosensitive drum 21 is recharged, whereby the irregularity of the charged potential is avoided to ensure that an image inferior in quality is prevented from being produced.

Since a corona discharge method is not employed for the contact charge eliminator 31 according to this embodiment of the invention, moreover, no substances (e.g., NOx) resulting from the discharge accompanied by the generation of ozone is allowed to adhere to the intermediate transfer belt 28 and bad secondary transfer due to the adhesion of the substances produced by electric discharge is effectively obviated.

In order to evaluate the performance pertaining to the problems above, a model embodying the present invention and two comparative models were used to form overall halftone images after the running of the same image for the purpose of making tests by examining the density difference between the image portion (solid portion) and the non-image portion (background portion) with the number of copies as a parameter.

Figure 9A:
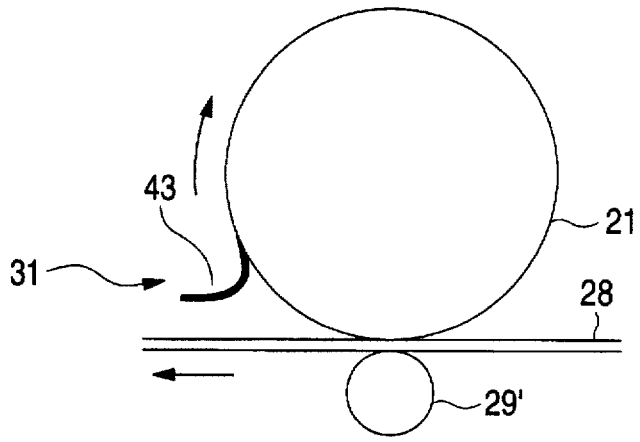
FIGS. 9A to 9C are illustrations of a model according to the embodiment 1 of the present invention and comparative models 1, 2.
Figure 9B:
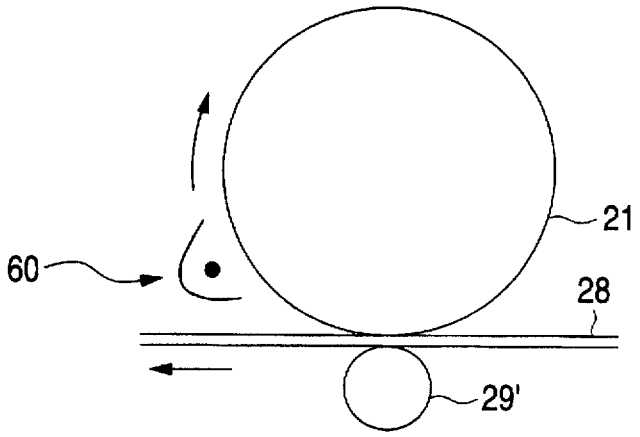

FIG. 9A shows a model embodying the present invention (using the contact charge eliminator 31 (conductive film 43)); FIG. 9B a comparative model using a corotron 60 as a charge eliminating means; and FIG. 9C another comparative model using the corotron 60 as a charge eliminating means, wherein an auxiliary shield plate 62 is attached to part of the shield 61 of the corotron 60 so as to cover the gap between the shield 61 and the photosensitive drum 21, whereby ions from the corotron 60 are not allowed to be thrown onto the intermediate transfer belt 28.

Figure 9C:
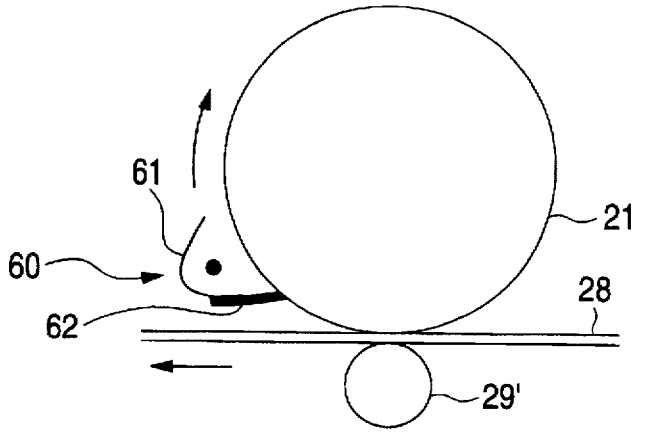

In the above case, a transfer roll 29', in place of the corona discharger 29, was used as a primary transfer member in each of FIGS. 9A to 9C to completely eliminate the influence of corona discharge on the primary transfer member side.

Figure 10:
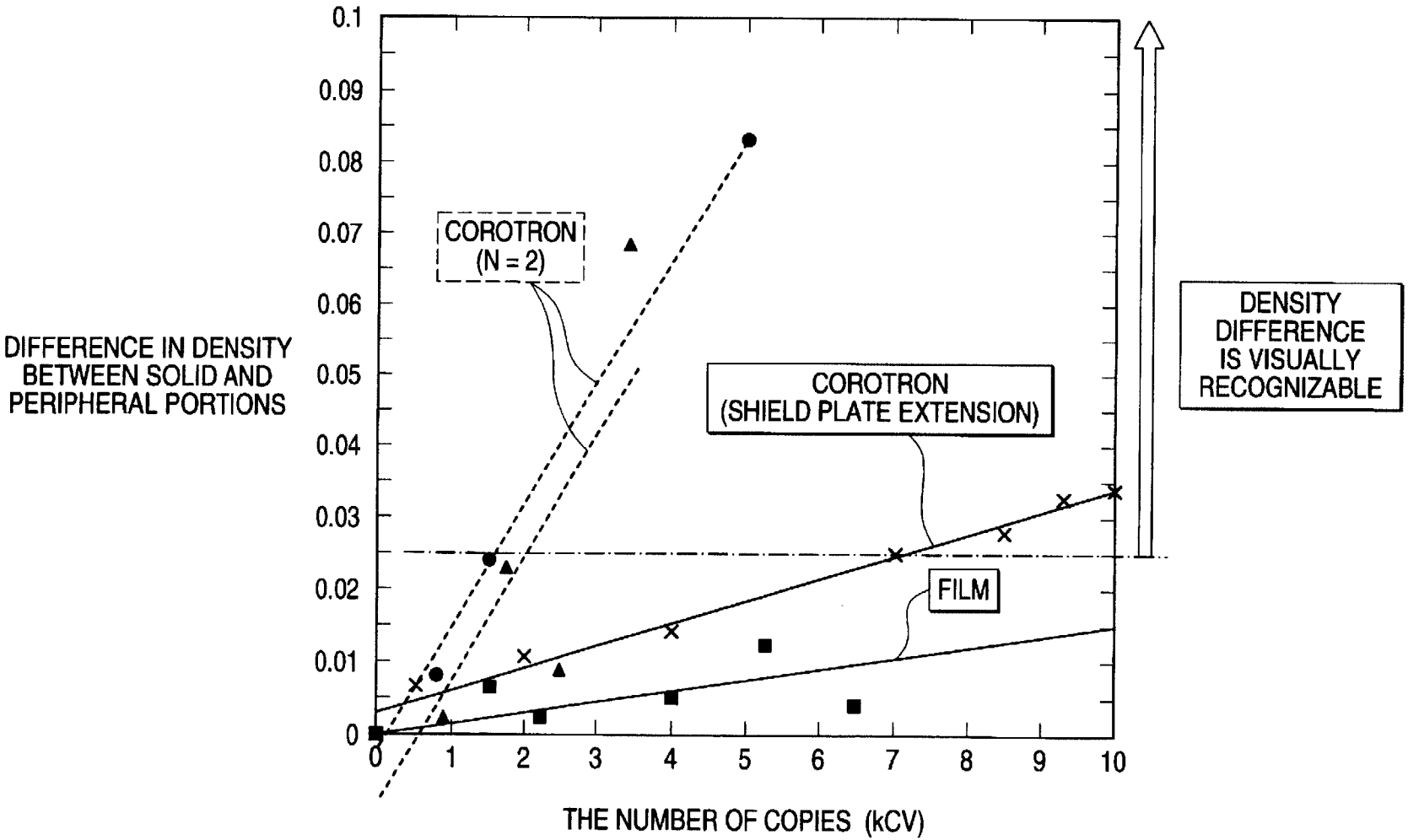
FIG. 10 is a graph showing the relationship of density difference between a solid and a peripheral portion by the model according to the embodiment 1 of the present invention and the comparative models 1, 2.

FIG. 10 shows the results of the tests. Incidentally, the density difference between the solid and peripheral portions in FIG. 10 was measured by a densitometer (Model 404 of X-Rite Co.).

As shown in FIG. 10, the density difference between the solid and peripheral portions in the model (FIG. 9A) according to the present invention turned out to be about 0.015 even though the number of copies reached 10,000 (10 kCV) as shown by a thick line of FIG. 10 and the density difference was ascertained to remain at such a level that it was visually unrecognizable.

Figure 11A:
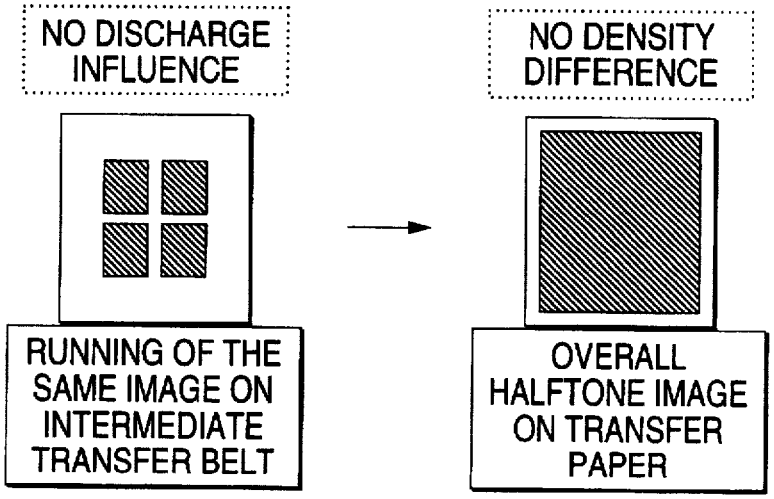
FIG. 11A is an illustration of the conditions of forming an overall halftone image after the running of the same image by the model according to the present invention.

In other words, it was confirmed that the overall halftone image on the transfer paper 35, which image had been formed after the running of the same image (the solid image and the background portion) formed on the intermediate transfer belt 28, was free from the density difference even when the number of copies reached 10,000 as shown in FIG. 11A.

On the contrary, the density difference between the solid and peripheral portions in the comparative model 1 (FIG. 9B) was ascertained to have reached a level (0.025) at which the density difference was visually recognized at a point of time the number of copies reached 1,500 (1.5 kCV) as shown by a dotted line (N=2 times) of FIG. 10.

Figure 11B:
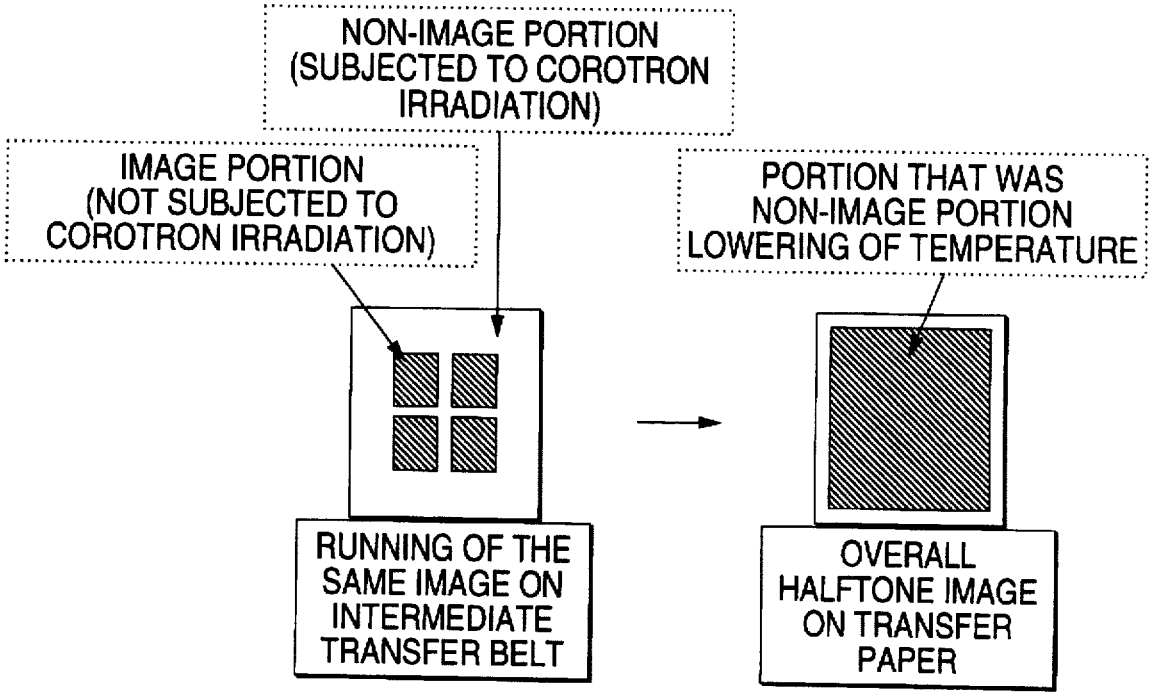
FIG. 11B is an illustration of the conditions of forming an overall halftone image after the running of the same image by the comparative model 1.

In other words, it was confirmed that the overall halftone image on the transfer paper 35, which image had been formed after the running of the same image (the solid image and the background portion) formed on the intermediate transfer belt 28, was seen to have produced a visually recognizable density difference when the number of copies reached about 1,500 as shown in FIG. 11B.

The density difference between the solid and peripheral portions in the comparative model 2 (FIG. 9C) was ascertained to have reached a level (0.025) at which the density difference was visually recognized at a point of time the number of copies reached 7,000 (7 kCV) or thereabouts as shown by a thin line of FIG. 10; the effect of avoiding bad secondary transfer due to the adhesion of the substances produced by electric discharge was understood to remain less than that of the model according to the present invention.

(Embodiment 2)

Figure 12:
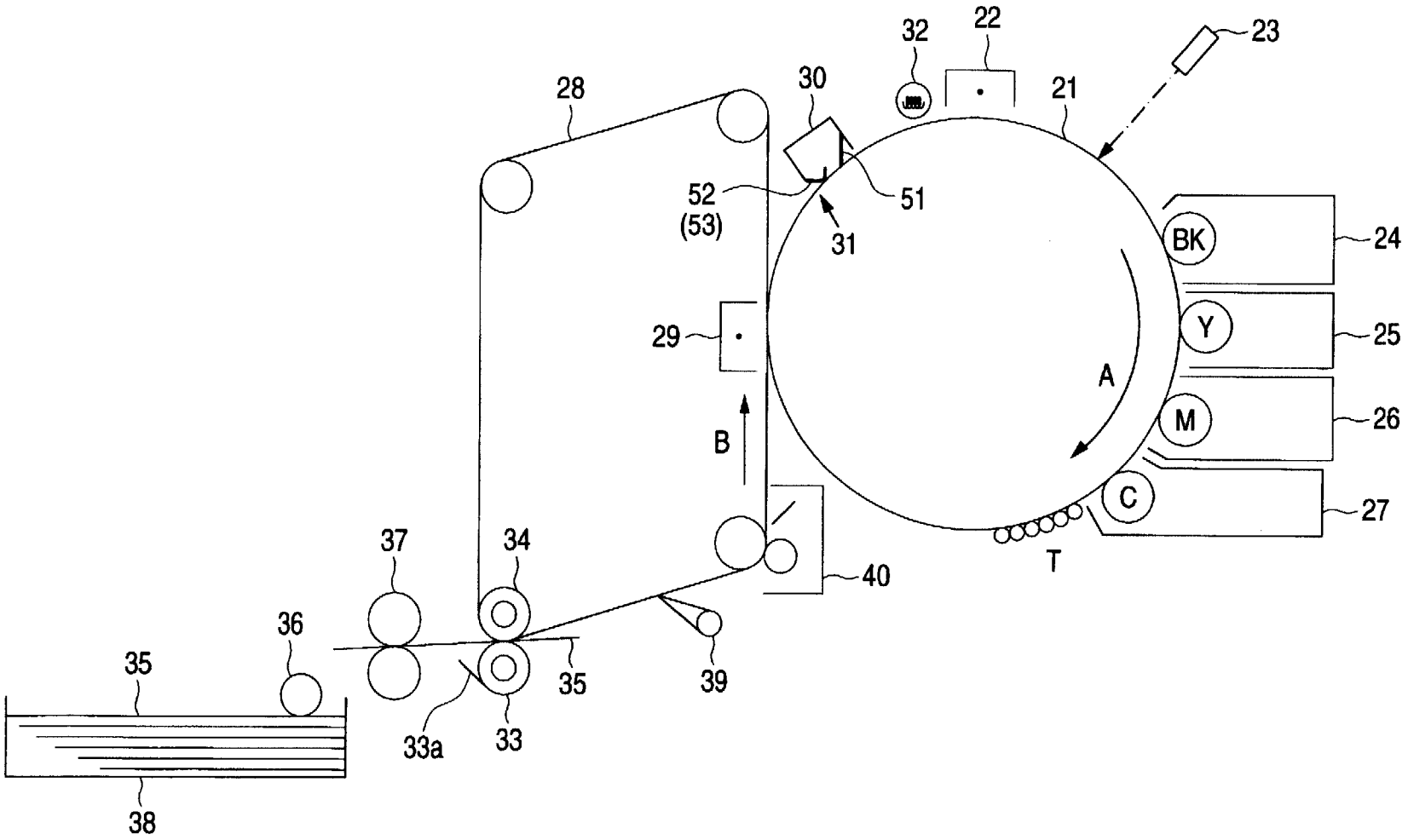
FIG. 12 is a schematic diagram of a color image forming apparatus in an embodiment 2 of the present invention.

FIG. 12 shows an embodiment 2 of the present invention applied to a color image forming apparatus, wherein like reference characters designate like component parts in the embodiment 2 thereof and the description thereof will be omitted.

Although the basic arrangement of the color image forming apparatus according to the embodiment 2 of the invention is substantially similar to that according to the embodiment 1 thereof, what makes the former different from the latter includes, unlike the embodiment 2, providing the drum cleaner 30 with a blade 51 and a toner receiving member 52 in the housing, wherein the toner receiving member 52 functions as a conductive film 53 or the contact charge eliminator 31.

As shown in FIG. 12, the conductive film 53 is placed on the upstream side in the direction in which the photosensitive drum 21 rotates with respect to the erase lamp 32 placed around the photosensitive drum 21 and between the uniform charger 22 and the primary transfer region where the intermediate transfer belt 28 faces the photosensitive drum 21.

FIG. 12 shows the conductive film 53 in detail according to the embodiment 2 of the invention.

As shown in FIG. 12, the conductive film 53 is substantially arcuate in cross section and its belly excluding the leading end portion is disposed so that it abuts against the photosensitive drum 21. The contact width of the contact portion has been set to L=3 mm or less according to this embodiment of the invention for the same reason as in the embodiment 1 of the present invention.

Figure 14:
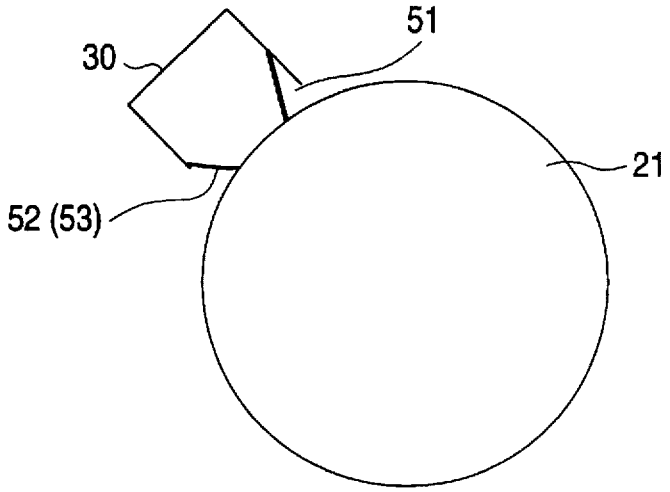
FIGS. 14A and 14B are comparative examples of the toner receiving member in the embodiment 2 of the present invention, respectively.
Figure 14:
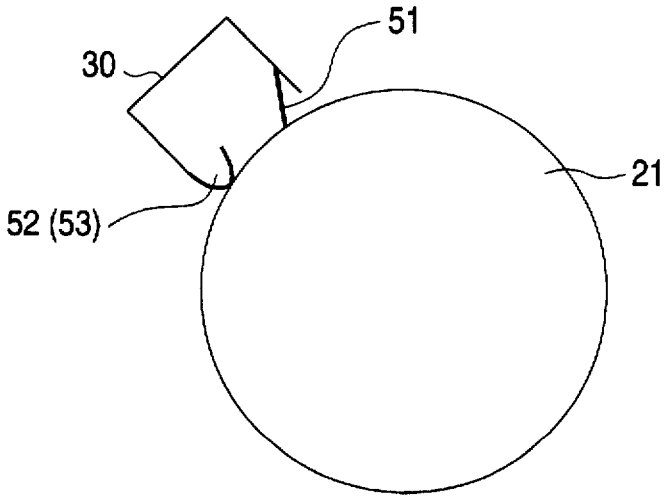

The reason for rendering the conductive film 53 substantially arcuate in cross section is that even though the contact width of the conductive film 53 with respect to the photosensitive drum 21 is set to L=3 mm or less, the photosensitive drum 21 is considered liable to be easily injured when the contact area is narrow in such a mode that the leading end portion of the conductive film 53 is kept in contact with the photosensitive drum 21, for example, as shown in FIG. 14A or that the bent belly of the conductive film 53 is kept in contact therewith as shown in FIG. 14B.

Figure 13:
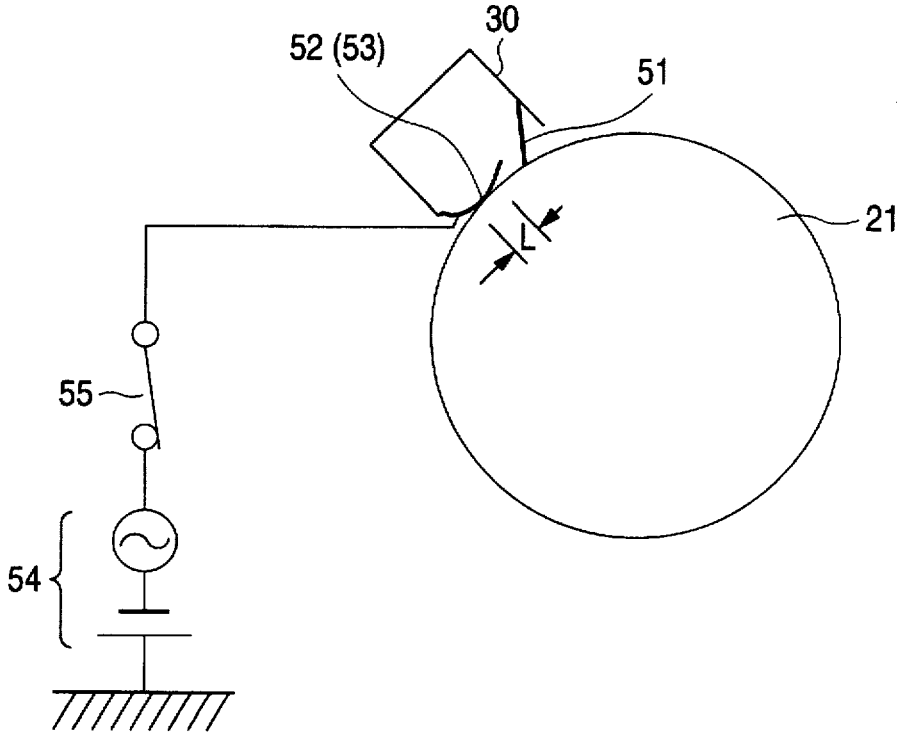
FIG. 13 is an illustration of the operation of a toner receiving member in the embodiment 2 of the present invention.

Further, the contact charge eliminator 31 according to this embodiment of the invention is arranged so that as shown in FIG. 13, the bias voltage derived from a power supply 54 is selectively applied via a switch 55 to the conductive film 53 and that the bias voltage is applied to the surface of the photosensitive drum 21 from a portion where the conductive film 53 and the photosensitive drum21 make contact with each other.

For the same reason as in the embodiment 1 of the present invention, the conductive film 53 even in the embodiment 2 thereof is prepared by, for example, having a suitable quantity of an antistatic agent such as carbon black contained in a polycarbonate having a thickness of 50–300 μm and a surface resistivity of $10^6\Omega/\square$.

According to this embodiment of the invention, moreover, an a.c. bias whose peak-to-peak voltage ranges from 1.0 kV to 4.1 kV is superposed on a d.c. voltage ranging from −0.6 kV to −2.0 kV and the combination is used as the bias voltage applied to the conductive film 53. The reason for the use of the alternating-current-superposed d.c. bias is based on the experimental data shown in FIG. 15.

Figure 15:
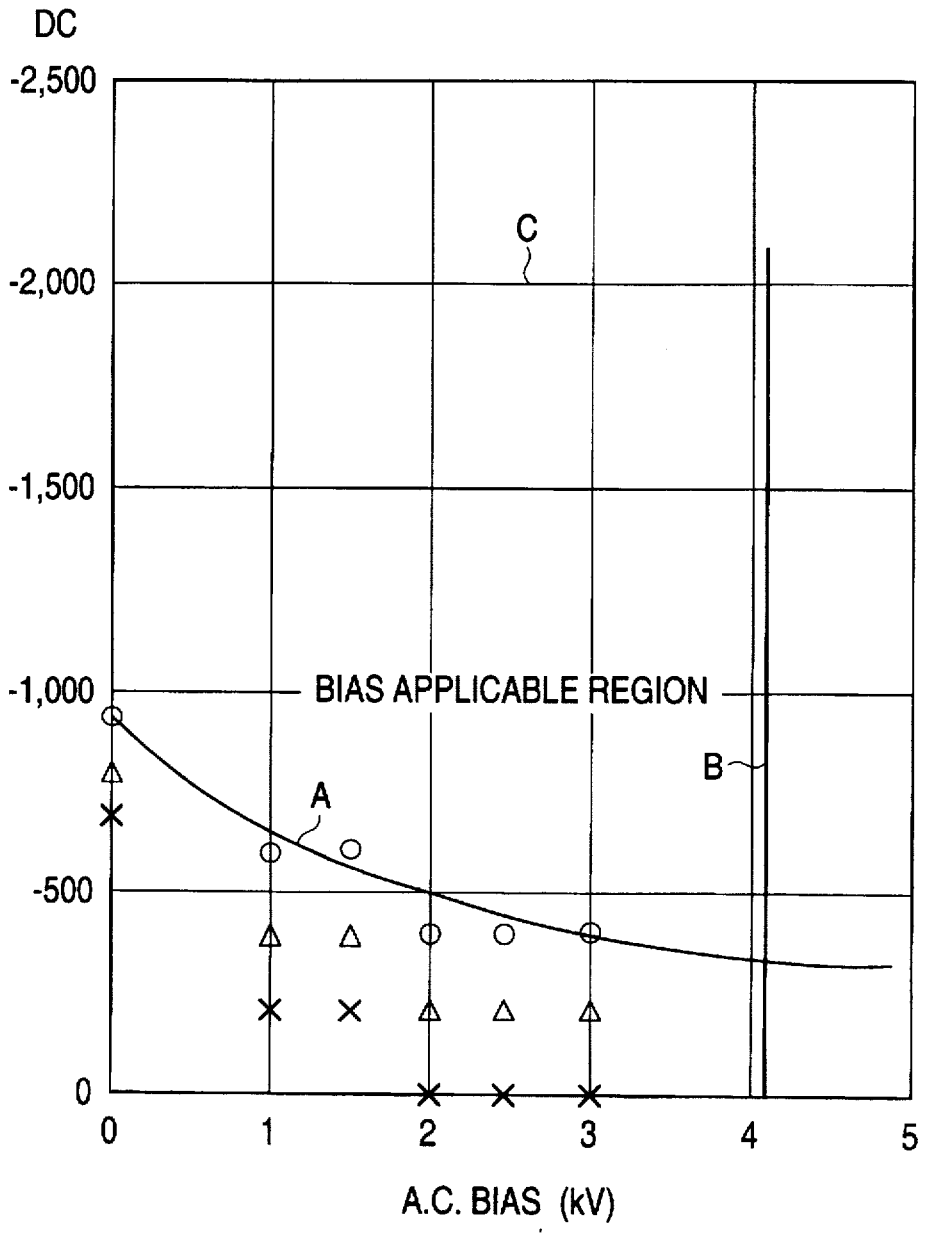
FIG. 15 is a graph showing a range of an alternating-current-superposed d.c. bias applicable by the toner receiving member in the embodiment 2 of the present invention.
Figure 16:
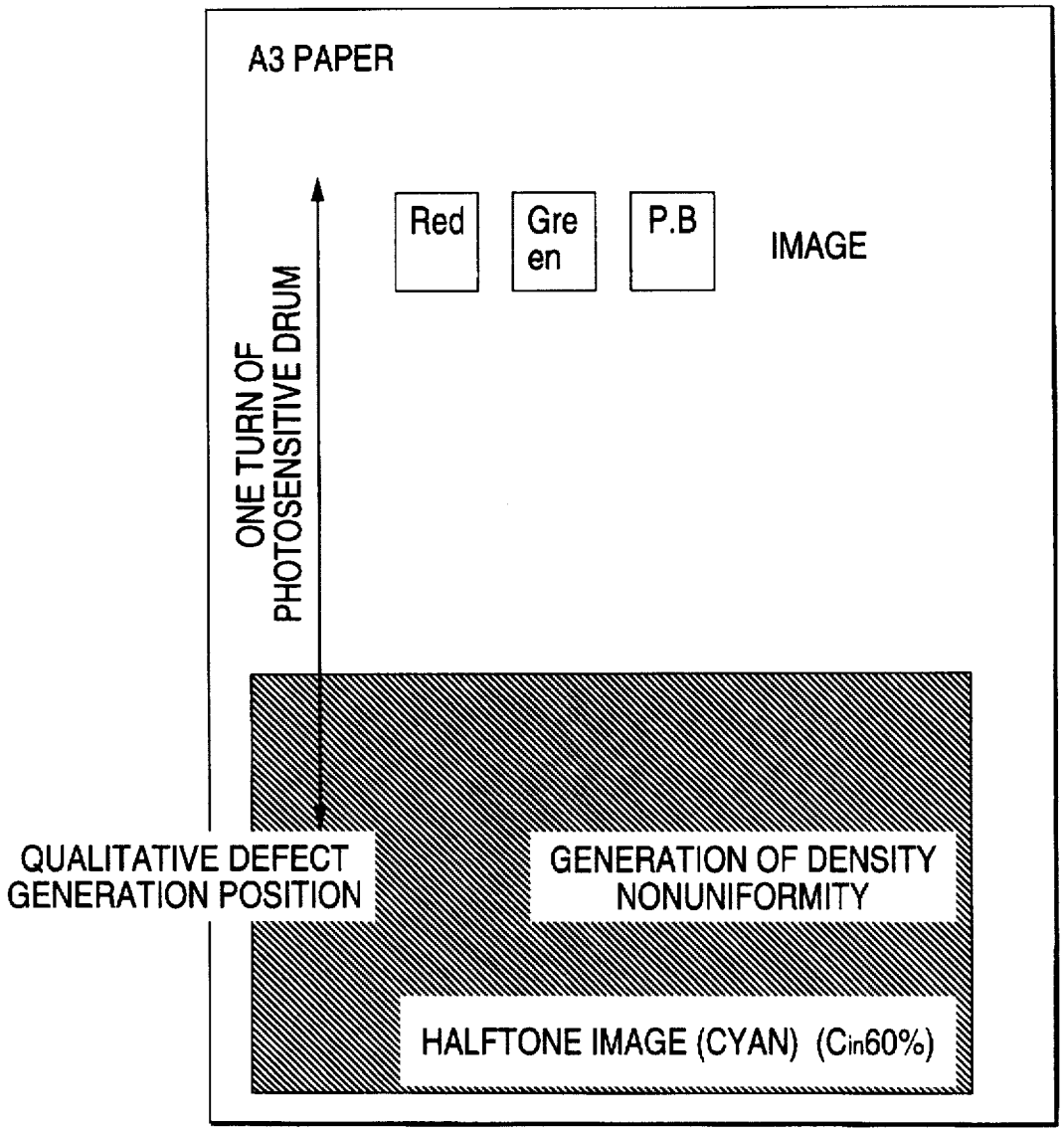
FIG. 16 is an illustration of an example of an image inferior in quality in embodiment 2 of the present invention.

As shown in FIG. 15, tests were made on the situations in which ghosts were produced in a case where halftone images were formed in a region as the non-image portion on the photosensitive drum 21 by varying the combination of values of d.c. components (DC) to be superposed on any a.c. bias. FIG. 16 shows an example of the test results. In FIG.

15, ○, Δ, x represent evaluation of the situations in which ghost were produced, wherein ○ indicates "not produced"; Δ, "slightly produced"; and x, "clearly produced."

With reference to FIG. 15, the formation of an image inferior in quality becomes recognized when the alternating-current-superposed d.c. bias voltage applied to the conductive film 53 is below a curve A.

When the d.c. component goes across a straight line C (−2.0 kV), the charged potential at the photosensitive drum 21 may exceed −1000 V, which is not desirous in consideration of the fact that in the case of a photosensitive drum 21 in the OPC-IR system normally used for a color image forming apparatus, the photosensitive drum 21 may be badly affected by a charged potential in excess of −1000 V.

When the a.c. voltage goes across a line B (peak-to-peak voltage at 4.1 kV), the conductive film 53 causes dielectric breakdown in view of the property of the material and the photosensitive drum 21 is adversely affected as holes are bored therein.

Therefore, according to this embodiment of the invention, the combination of the peak-to-peak voltage ranging from 1.0 kV to 4.1 kV and the a.c. bias ranging from −0.6 kV to −2.0 kV is used.

Figure 17:
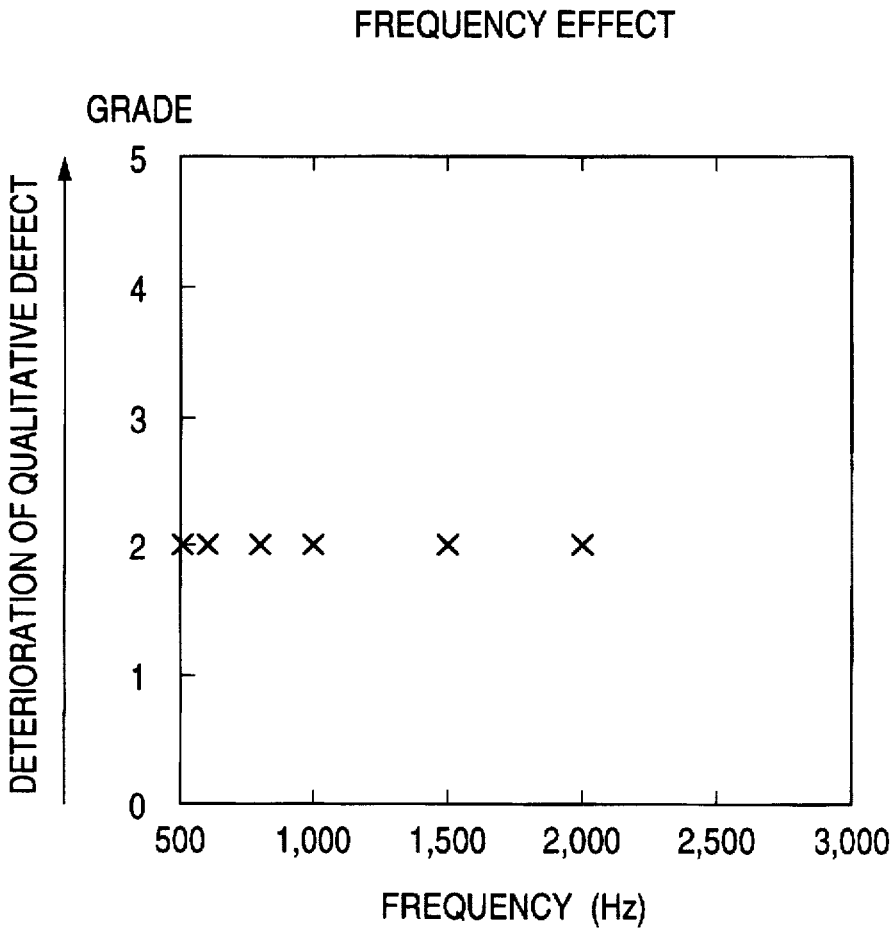
FIG. 17 is a graph showing the frequency effect with respect to the image inferior in quality in the embodiment 2 of the present invention.
Figure 18:
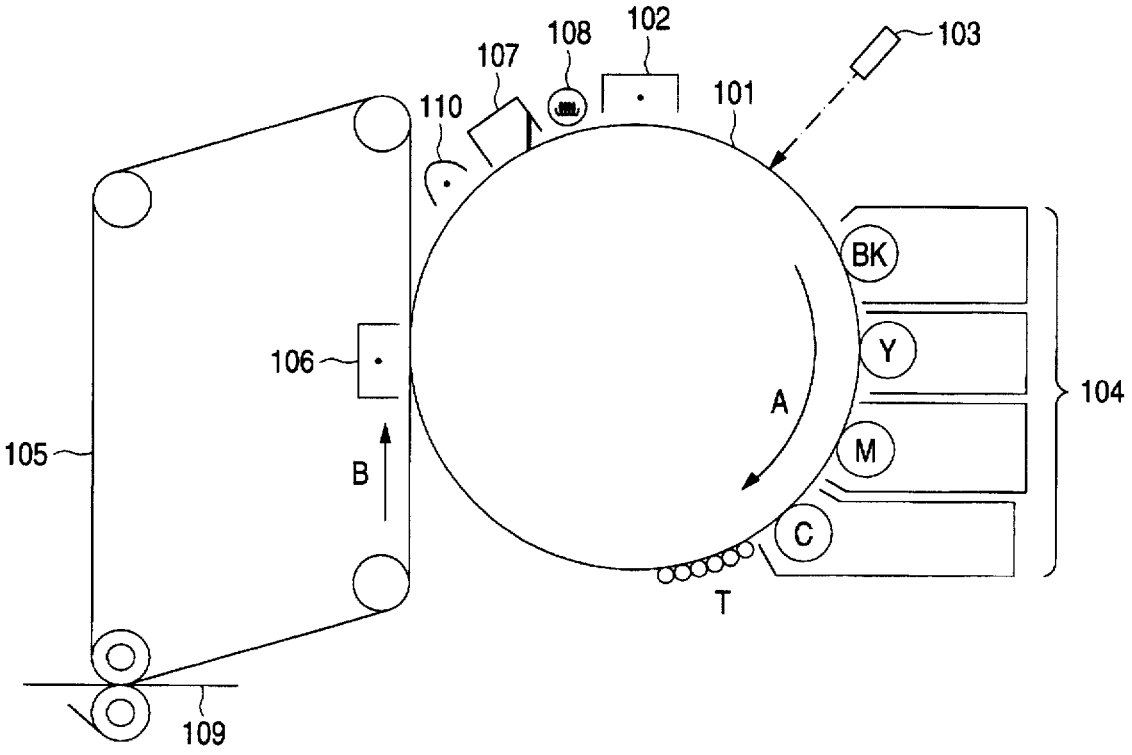
FIG. 18 is a schematic diagram of a conventional image forming apparatus.
Figure 19:
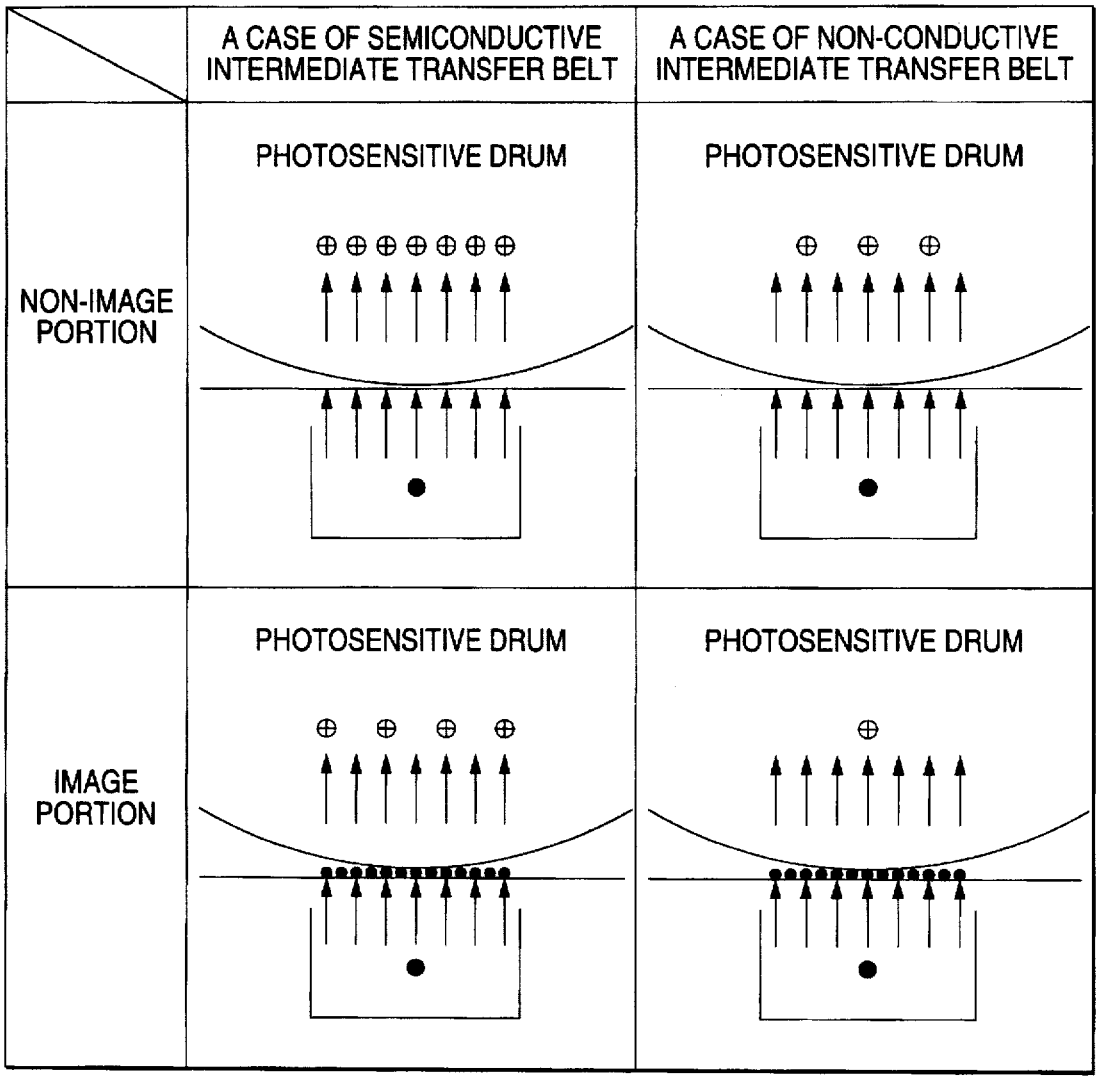
FIG. 19 PRIOR ART
FIG. 19 is an illustration of the principle of injecting electric charge into the conventional image forming apparatus.
Figure 20:
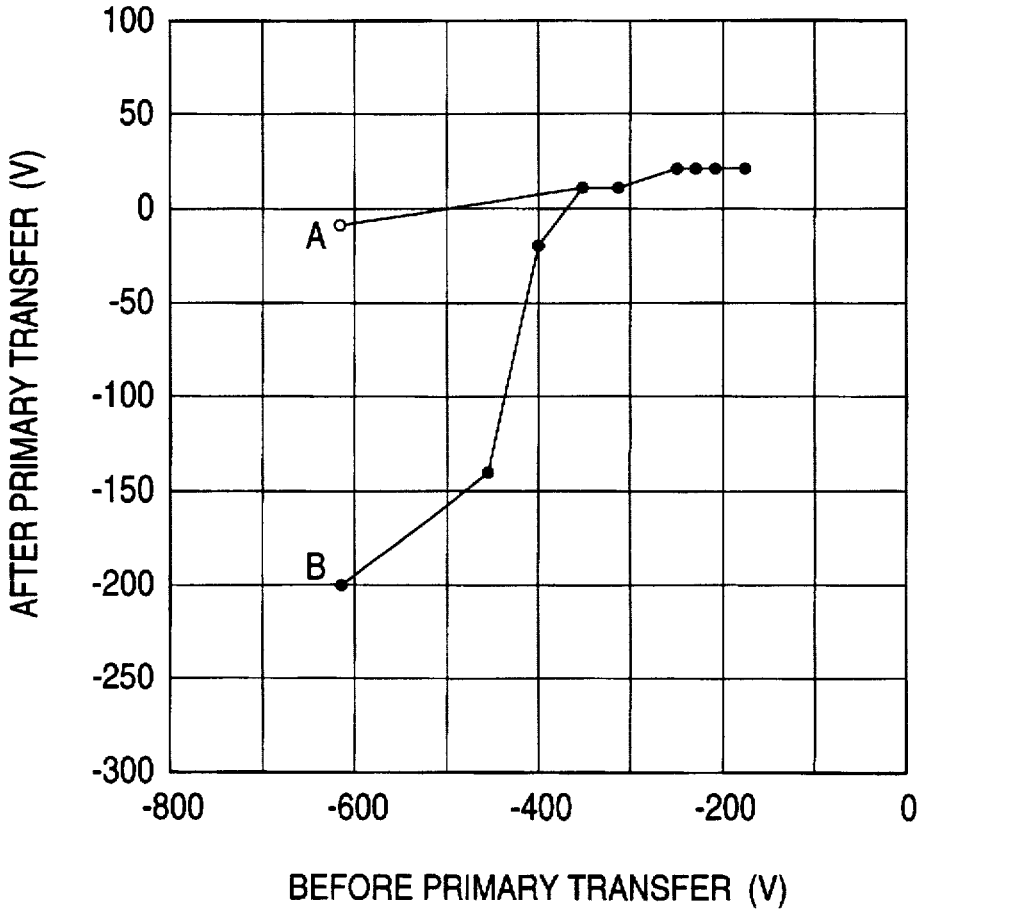
FIG. 20 PRIOR ART
FIG. 20 is a graph showing potential variations before and after the primary transfer to the photosensitive layer of the conventional image forming apparatus.
Figure 21:
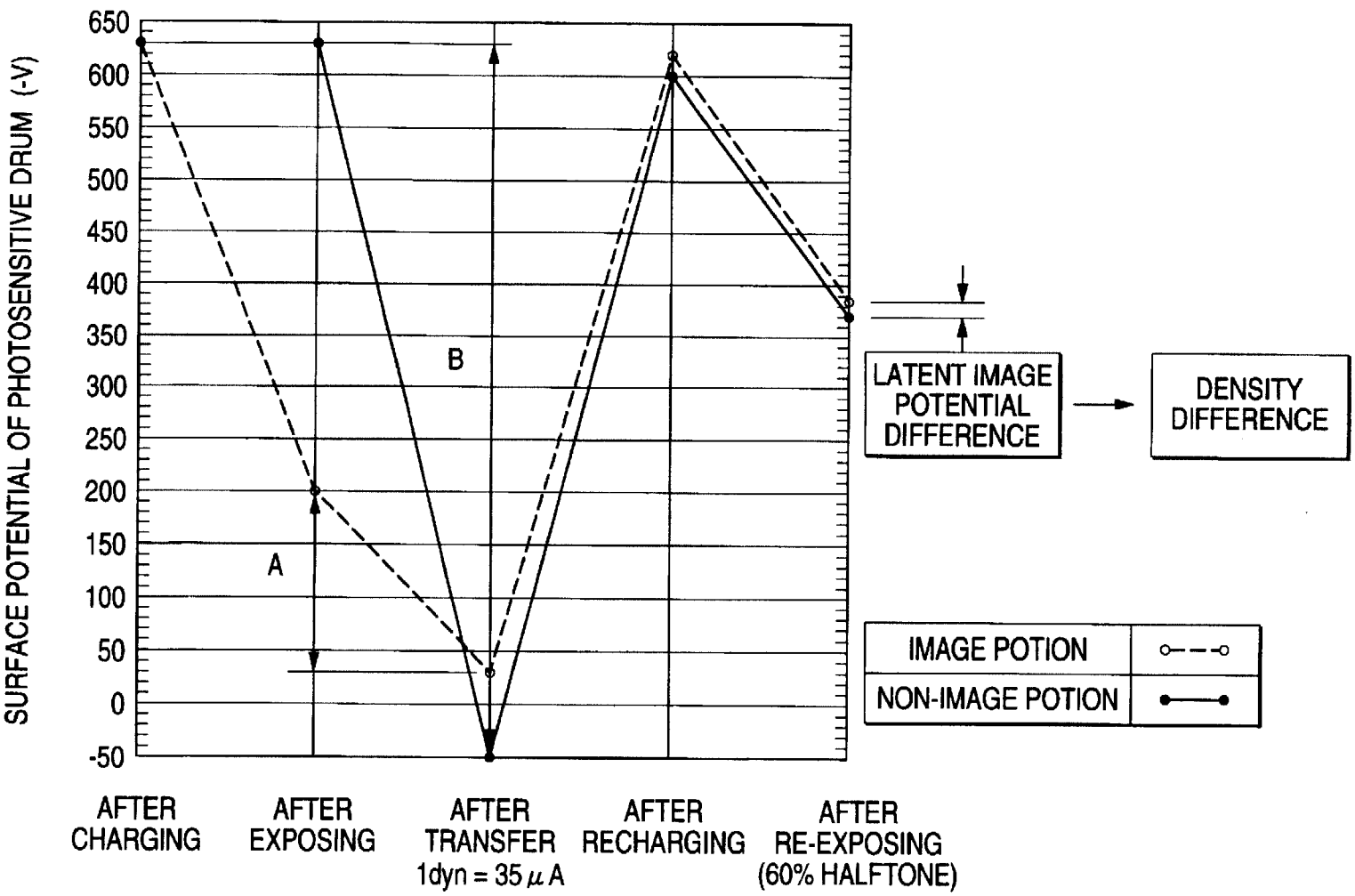
FIG. 21 PRIOR ART
FIG. 21 is a graph showing the time potential variations of the photosensitive layer of the conventional image forming apparatus.
Figure 22:
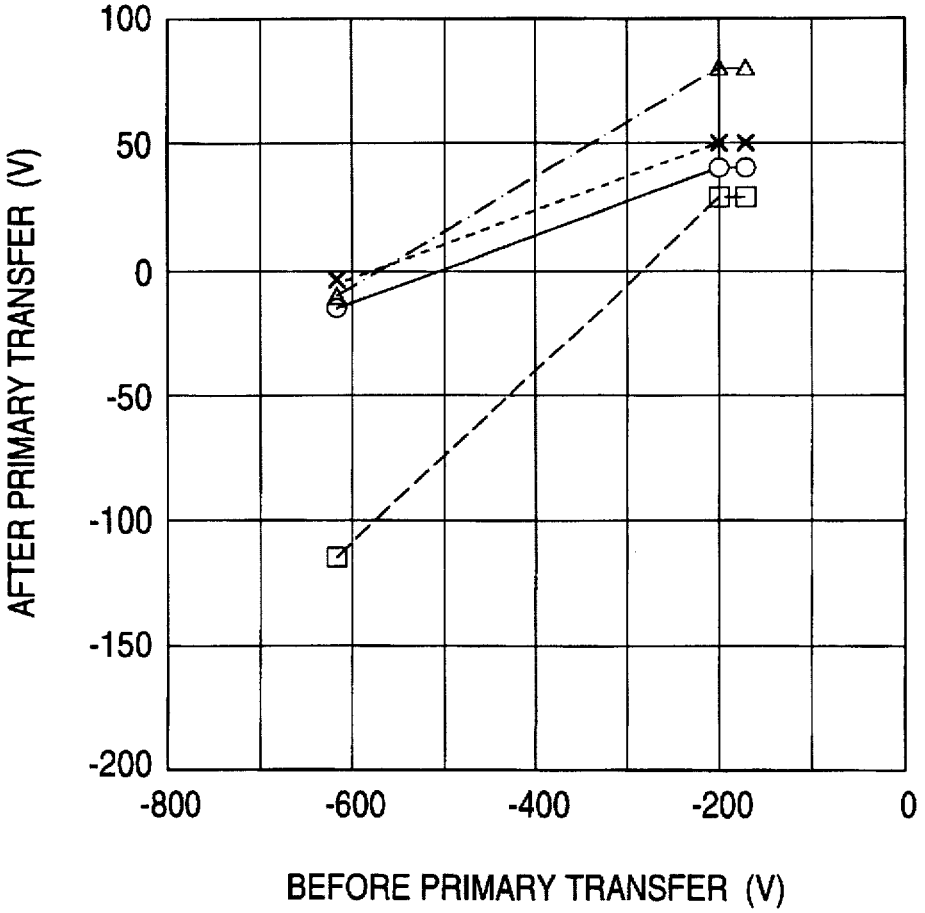
FIG. 22 PRIOR ART
FIG. 22 is a graph showing the influence of the primary transfer current value when electric charge is injected into the photosensitive layer of the conventional image forming apparatus.
Figure 23:
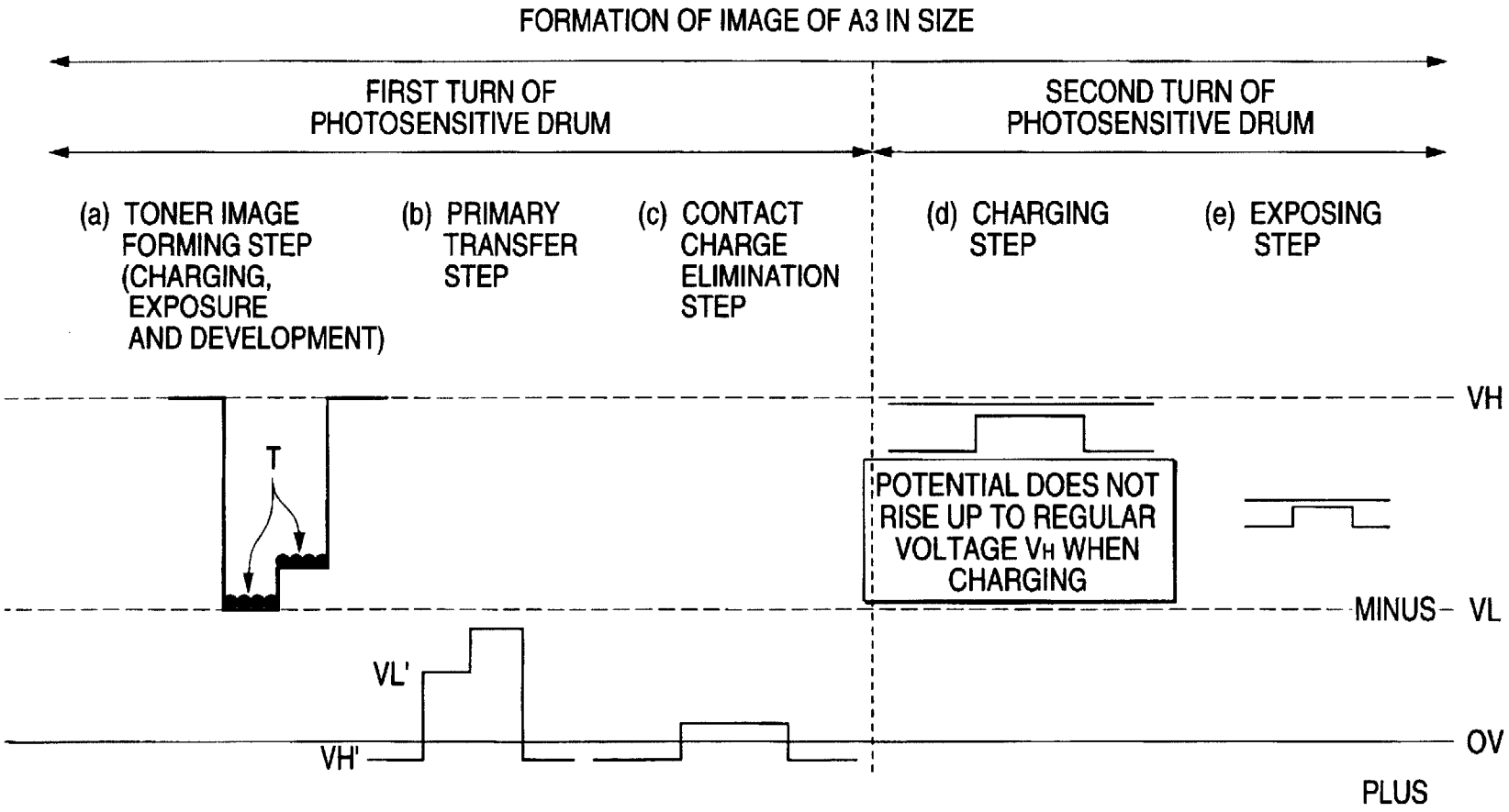
FIG. 23 PRIOR ART
FIG. 23 is a graph showing the mechanism of forming an image inferior in quality in the conventional image forming apparatus.

Regarding the frequency, 600 Hz is set in consideration of the fact that the image quality is not badly affected by the frequency in a sense that normally it does not worsen the deterioration of the image quality as shown in FIG. 17.

Therefore, the embodiment 2 of the invention achieves the same effect as that of the embodiment 1 thereof and by using the toner receiving member 52 attached to the conventional drum cleaner 30 simultaneously as the conductive film 53 and making the conductive film 53 a contact charge-eliminator 31 to which the bias is applied, it is possible to not only prevent waste toner from falling out of the drum cleaner 30 but also eliminate the electric charge injected into the photosensitive drum 21 together with the residual toner as well as the carrier on the photosensitive drum 21 after the primary transfer.

The positively charged untransferred toner is also returned to a negatively charged one at the primary transfer step by applying the aforementioned bias voltage to the toner receiving member 52 (conductive film 53), whereby the toner sticking to a toner removing member (blade 51) is not kept in contact with the photosensitive drum 21 in the positive state; thus, the photosensitive drum21 is not badly affected thereby.

As set forth above, according to the present invention, the electric charge injected into the photosensitive member after the primary transfer of the toner image on the photosensitive member to the semi-conductive intermediate transfer member is optically and completely eliminated from the photosensitive member after the contact charge-eliminating means (the conductive member to which the bias voltage is applied) is caused to make contact with the surface of photosensitive member to ensure that the electric charge injected into the photosensitive member through the semi-conductive intermediate transfer member is removed. Therefore, irregular charging is prevented when the photosensitive member is electrically charged again to the above extent. Thus, a good image free from qualitative defects such as the density difference (e.g., development ghost) accompanied by the irregular charging can be formed.

According to the present invention, moreover, since a corona discharge method is not employed as the charge eliminating means with respect to the photosensitive member, it is possible to effectively avoid the situation in which the substances produced by electric discharge due to the generation of ozone adhere to the surface of the semi-conductive intermediate transfer member, thus lowering the transferability of the deposit.

Consequently, the bad secondary transfer accompanied by the adhesion of the substances produced by electric discharge to the semi-conductive intermediate transfer member is obviated, whereby a good image free from qualitative defects such as the density difference and a blank portion can be formed.

According to the present invention, further, use of the toner receiving member attached to the conventional cleaning means simultaneously as the conductive member makes not only the provision of a separate conductive member unnecessary but also the formation of a stable image free from defects possible, so that an image forming apparatus favorable for size and cost reduction is obtainable.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image forming method, comprising the steps of:

uniformly electrically charging a photoconductive layer on a surface of a photosensitive member with charging means;

exposing the surface of said photosensitive member to form an electrostatic latent image corresponding to image information with exposure means;

forming a toner image to visualize said electrostatic latent image with developing means which is stored with toner identical in polarity to said photosensitive member;

making a primary transfer of said toner image to a semi-conductive intermediate transfer member by electrically charging said semi-conductive intermediate transfer member at a first potential opposite in polarity to a second potential at said photosensitive member with primary transfer means;

contact-eliminating a residual electric charge of said photosensitive member after the primary transfer of said toner image using a conductive member that makes contact with said photosensitive member, said conductive member having an electric charge opposite in polarity to said photosensitive member; and optically removing the electric charge from said photosensitive member with optical charge-eliminating means after said contact charge eliminating step.

2. An image forming apparatus, comprising:

a photosensitive member whose surface is covered with a photoconductive layer;

a semi-conductive intermediate transfer member disposed opposite to said photosensitive member;

charging means for uniformly electrically charging the surface of said photosensitive member;

exposure means for forming an electrostatic latent image corresponding to image information on said photosensitive member;

developing means for forming a toner image by visualizing said electrostatic latent image using toner identical in polarity to said photosensitive member;

primary transfer means for transferring said toner image to said intermediate transfer member by electrically charging said intermediate transfer member at a first potential opposite in polarity to a second potential at said photosensitive member;

secondary transfer means for transferring said toner image on said intermediate transfer member to a transfer material;

optical charge-eliminating means placed on a downstream side in a direction in which said photosensitive member is rotated in a region corresponding to said primary transfer means, which region is located close to said photosensitive member;

contact charge-eliminating means placed close to said photosensitive member and between the region corresponding to said primary transfer means and said optical charge-eliminating means, said contact charge-eliminating means including a conductive member which makes contact with the surface of said photosensitive member; and bias applying means for applying to said conductive member a bias for removing a residual potential on said photosensitive member after the primary transfer.

3. An image forming apparatus as claimed in claim 2, wherein said conductive member comprises a conductive film.

4. An image forming apparatus as claimed in claim 2, wherein when said apparatus is of a type employing a negatively-polarized photosensitive member, a bias voltage applied to said bias applying means is one of the following voltages: a d.c. voltage ranging from −0.8 kV to −2.0 kV and a direct-current-superposed a.c. voltage which is a combination of an a.c. voltage whose peak-to-peak voltage ranges from 1.0 kV to 4.1 kV and a d.c. current component ranging from −0.6 kV to −2.0 kV.

5. An image forming apparatus as claimed in claim 2, wherein when said apparatus is of a type employing cleaning means for peeling and removing a residual toner on said photosensitive member, said conductive member is simultaneously used as a toner receiving member for said cleaning means.

6. An image forming apparatus as claimed in claim 2, wherein a belly portion, excluding a leading end portion, of said conductive member selectively makes contact with said photosensitive member.

7. An image forming apparatus as claimed in claim 2, wherein when said conductive member is formed of one of a polyimide region and a polycarbonate region, a contact width of said conductive member with said photosensitive member is 3 mm or less.

8. An image forming apparatus as claimed in claim 2, wherein a surface resistivity of said conductive member ranges from $10^2$ to $10^{11}\Omega/\square$.

9. An image forming apparatus as claimed in claim 2, wherein a timing at which a bias voltage is applied by said bias applying means to said conductive member is effected only during a time said conductive member is electrically charged by said primary transfer means.

10. An image forming apparatus as claimed in claim 2, wherein a bias voltage applied to said conductive member is set variable as said photosensitive member undergoes fatigue with a lapse of time.

* * * * *